US009328681B2

(12) United States Patent
Takada et al.

(10) Patent No.: US 9,328,681 B2
(45) Date of Patent: May 3, 2016

(54) CONTROL APPARATUS FOR INTERNAL COMBUSTION ENGINE

(75) Inventors: Norifumi Takada, Susono (JP); Tomoaki Honda, Gotenba (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 811 days.

(21) Appl. No.: 13/535,510

(22) Filed: Jun. 28, 2012

(65) Prior Publication Data

US 2013/0006506 A1 Jan. 3, 2013

(30) Foreign Application Priority Data

Jun. 29, 2011 (JP) ..... 2011-144173

(51) Int. Cl.

| | |
|---|---|
| ***F02D 41/04*** | (2006.01) |
| ***F02D 41/00*** | (2006.01) |
| ***F02D 41/14*** | (2006.01) |
| ***F02D 41/02*** | (2006.01) |
| ***F01N 13/00*** | (2010.01) |

(52) U.S. Cl.

CPC ..... *F02D 41/0085* (2013.01); *F01N 13/009* (2014.06); *F02D 41/0295* (2013.01); *F02D 41/1441* (2013.01); *F02D 41/1473* (2013.01); *F01N 2560/025* (2013.01); *F01N 2560/14* (2013.01); *F02D 41/04* (2013.01); *F02D 41/1475* (2013.01)

(58) Field of Classification Search

CPC ..... F01N 3/00; F01N 3/025; F01N 3/0253; F01N 3/035; F02D 41/008; F02D 41/0082; F02D 41/04; F02D 41/0295

USPC ..... 123/673; 60/303

See application file for complete search history.

(56) References Cited

U.S. PATENT DOCUMENTS

| | | | | |
|---|---|---|---|---|
| 6,868,326 | B2 * | 3/2005 | Yasui | F02D 41/1403 123/672 |
| 8,047,064 | B2 * | 11/2011 | Iwazaki et al. | 73/114.72 |
| 8,186,148 | B2 * | 5/2012 | Gabe et al. | F01N 3/0814 60/285 |
| 8,452,517 | B2 * | 5/2013 | Sawada et al. | F02D 41/0085 123/692 |
| 8,554,447 | B2 * | 10/2013 | Okazaki et al. | F02D 41/1454 123/672 |
| 8,718,902 | B2 * | 5/2014 | Katou et al. | F02D 41/0065 123/568.21 |
| 8,826,642 | B2 * | 9/2014 | Aisaka et al. | 60/276 |
| 8,892,337 | B2 * | 11/2014 | Kitano et al. | F02D 41/0085 123/479 |
| 8,938,947 | B2 * | 1/2015 | Nakamura | 60/277 |
| 8,949,001 | B2 * | 2/2015 | Suzuki | F02D 41/3005 123/691 |
| 8,997,458 | B2 * | 4/2015 | Yoshioka | 60/285 |
| 2007/0261391 | A1 * | 11/2007 | Takubo | 60/285 |

(Continued)

FOREIGN PATENT DOCUMENTS

| | | |
|---|---|---|
| JP | 2005-120870 A | 5/2005 |
| JP | 2007-315193 A | 12/2007 |

(Continued)

*Primary Examiner* — Thomas Moulis
(74) *Attorney, Agent, or Firm* — Dinsmore & Shohl LLP

(57) ABSTRACT

A control apparatus for a multicylinder internal combustion engine includes: a detection portion that detects a parameter that represents degree of variation in air/fuel ratio among cylinders; a measurement portion that measures stored oxygen amount of a catalyst provided in an exhaust passageway of the internal combustion engine; and a rich-control portion that switches between execution and stop of a rich control for enriching the air/fuel ratio according to the stored oxygen amount measured by the measurement portion when the parameter detected by the detection portion is greater than or equal to a predetermined value.

14 Claims, 18 Drawing Sheets

(56) References Cited

U.S. PATENT DOCUMENTS

| | | | | |
|---|---|---|---|---|
| 2008/0245056 | A1* | 10/2008 | Kawakita et al. | 60/276 |
| 2009/0260347 | A1* | 10/2009 | Iwazaki et al. | 60/277 |
| 2010/0168986 | A1* | 7/2010 | Iwazaki et al. | 701/103 |
| 2010/0307135 | A1* | 12/2010 | Miyamoto et al. | 60/277 |
| 2011/0054761 | A1 | 3/2011 | Sawada et al. | |
| 2011/0191005 | A1* | 8/2011 | Iwazaki et al. | 701/101 |
| 2011/0282541 | A1 | 11/2011 | Kidokoro et al. | |

FOREIGN PATENT DOCUMENTS

| | | | |
|---|---|---|---|
| JP | 2008-002435 | A | 1/2008 |
| JP | 2009-030455 | A | 2/2009 |
| JP | 2009-203940 | A | 9/2009 |
| JP | 2011-047332 | A | 3/2011 |
| WO | 2010087026 | A1 | 8/2010 |
| WO | 2011/155073 | A1 | 12/2011 |

* cited by examiner

COMPARATIVE EXAMPLE

COMPARATIVE EXAMPLE

COMPARATIVE EXAMPLE

COMPARATIVE EXAMPLE

COMPARATIVE EXAMPLE

Ne
Ne1

KL
KL1
t1
t4

RICH FLAG
ON
OFF

OSA FLAG
ON
OFF

OSA
A3
A2
A1

A/Ft
LEAN
STOICHI-
OMETRIC
RICH

HC
Cx
t2
t21
t22
t23
t24
t25
t3
TIME

CONTROL APPARATUS FOR INTERNAL COMBUSTION ENGINE

CROSS REFERENCE TO RELATED APPLICATIONS

This application claims priority to Japanese Patent Application No. 2011-144173 filed on Jun. 29, 2011, which is incorporated herein by reference in its entirety including the specification, drawings and abstract.

BACKGROUND OF THE INVENTION

1. Field of the Invention

The invention relates to a control apparatus for an internal combustion engine and, more particularly, to an apparatus capable of restraining deterioration of exhaust emissions of a multicylinder internal combustion engine when the air/fuel ratio varies among the cylinders of the engine.

2. Description of Related Art

Generally, in an internal combustion engine equipped with an exhaust emission control system that uses a catalyst, it is essential to control a mixing ratio of air and fuel in a mixture that is burned in the internal combustion engine, that is, the air/fuel ratio, in order to accomplish high-efficient removal of pollutants from exhaust gas through the use of a catalyst. In order to perform such a control of the air/fuel ratio, an air/fuel ratio sensor is provided in an exhaust passageway of the internal combustion engine, and a feedback control is carried out so as to cause the air/fuel ratio detected by the sensor to be equal to a predetermined target air/fuel ratio.

Usually, in a multicylinder internal combustion engine, the air/fuel ratio control is performed by using the same control amount for all the cylinders; therefore, despite the execution of the air/fuel feedback ratio control, the actual air/fuel ratio can vary among the cylinders. In such a case, if the variation of the air/fuel ratio is of a small degree, the variation of the air/fuel ratio can be absorbed by the air/fuel ratio feedback control and pollutants in exhaust gas can be removed by the catalysts. Thus, small degrees of variation of the air/fuel ratio do not affect the exhaust emissions.

However, if the air/fuel ratio greatly varies among the cylinders due to, for example, failure of the fuel injection system of at least one cylinder or the like, exhaust emissions deteriorate.

It is desirable that such a large variation of the air/fuel ratio be detected as an abnormality. Particularly, in the case of the internal combustion engines used in motor vehicles, in order to prevent a vehicle from traveling with deteriorated exhaust emissions, it has been demanded that an inter-cylinder air/fuel ratio variation abnormality of the engine be detected in a vehicle-mounted state (an on-board state). For example, in an apparatus described in Japanese Patent Application Publication No. 2009-30455 (JP 2009-30455 A), the inter-cylinder air/fuel ratio variation abnormality is detected on the basis of divergences of the outputs of air/fuel ratio sensors disposed upstream and downstream of a catalyst.

Typically, the foregoing air/fuel ratio feedback control is performed on the basis of the output of the air/fuel ratio sensor disposed upstream of the catalyst, that is, the pre-catalyst sensor. Furthermore, if the air/fuel ratio of a cylinder greatly deviates to the rich side in a multicylinder internal combustion engine, the output of the pre-catalyst sensor deviates to the rich side from a true air/fuel ratio due to the influence of hydrogen discharged from the cylinder of rich deviation (see JP 2009-30455 A).

If, in such a state, the air/fuel ratio feedback control is performed in a usual manner, the actual air/fuel ratio of exhaust gas deviates to the lean side of the target air/fuel ratio, giving rise to possibility of increase in the amount of NOx emissions.

A conceivable countermeasure against this is to restrain or offset a lean deviation of the actual exhaust air/fuel ratio by enriching the air/fuel ratio if an inter-cylinder air/fuel ratio variation is detected.

However, according to results of researches made by the present inventors, it has turned out that if such enrichment of the air/fuel ratio is continued, the enrichment can become excessive and result in increased amounts of HC emissions.

SUMMARY OF THE INVENTION

The invention provides a control apparatus for an internal combustion engine which is capable of restraining the deterioration of exhaust emissions that occurs in the case where the air/fuel ratio varies among the cylinders and therefore the air/fuel ratio enrichment is executed.

A control apparatus for a multicylinder internal combustion engine in accordance with one aspect of the invention includes: a detection portion that detects a parameter that represents degree of variation in air/fuel ratio among cylinders of the multicylinder internal combustion engine; a measurement portion that measures stored oxygen amount of a catalyst provided in an exhaust passageway of the internal combustion engine; and a rich-control portion that switches between execution and stop of a rich control for enriching the air/fuel ratio according to the stored oxygen amount measured by the measurement portion when the parameter detected by the detection portion is greater than or equal to a predetermined value.

The foregoing aspect of the invention achieves an excellent effect of being able to restrain the deterioration of exhaust emissions that occurs when the air/fuel ratio varies among the cylinders and therefore the enrichment of the air/fuel ratio is executed.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Embodiments of the invention will be described hereinafter with reference to the accompanying drawings.

Figure 1:
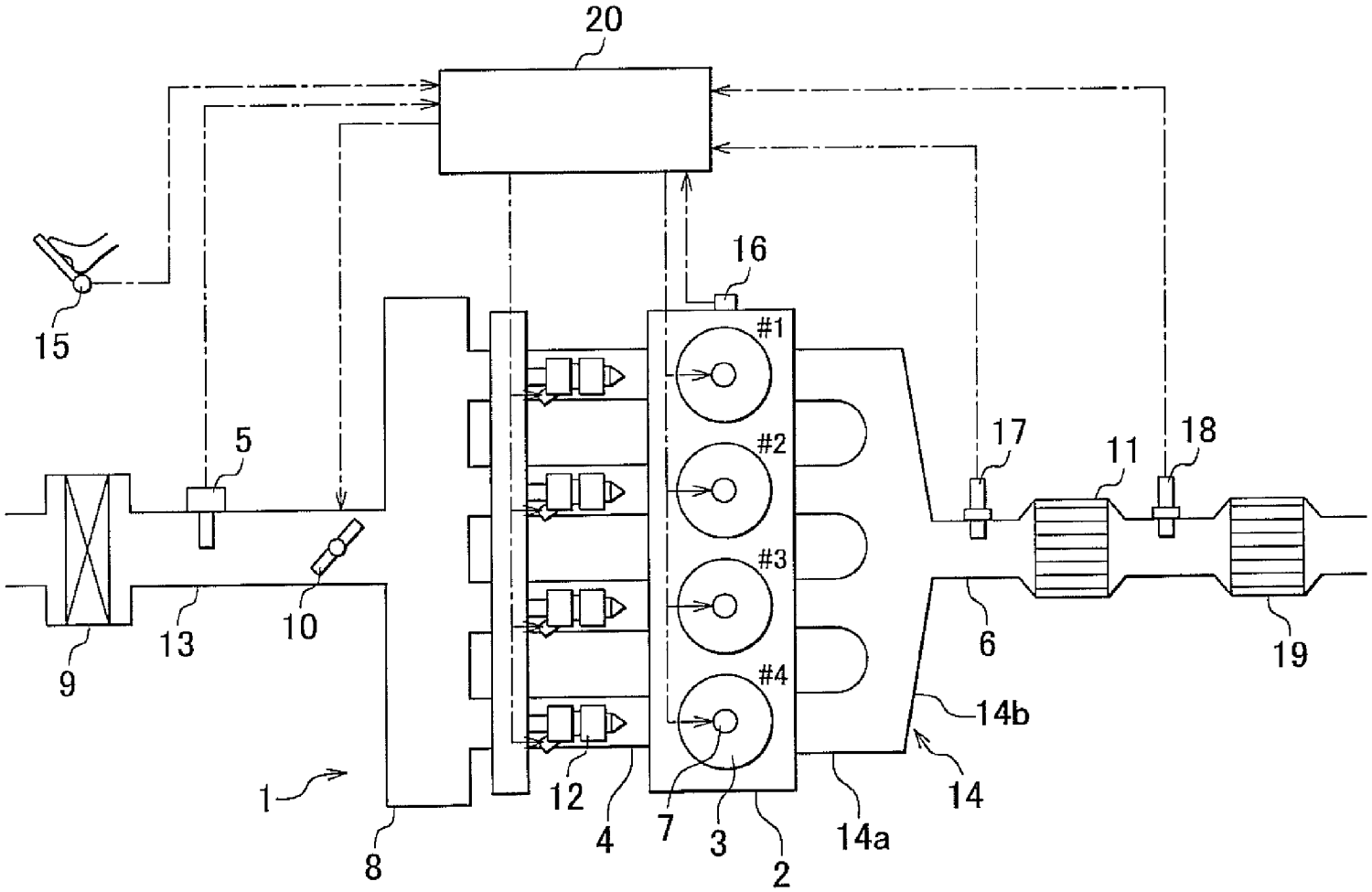
FIG. 1 is a general diagram of an internal combustion engine in accordance with an embodiment of the invention.

FIG. 1 is a general diagram of an internal combustion engine in accordance with an embodiment of the invention. As shown in FIG. 1, the internal combustion engine (engine) 1 produces power by burning a mixture of fuel and air in combustion chambers 3 that are formed in a cylinder block 2 so as to reciprocate a piston in each combustion chamber 3. The internal combustion engine 1 in this embodiment is a multicylinder internal combustion engine mounted in a motor vehicle and, more concretely, an in-line four-cylinder spark ignition type internal combustion engine. The internal combustion engine 1 has #1 to #4 cylinders. However, the number of cylinders, the use of the engine, the type thereof, etc., are not particularly limited.

Although not shown in the drawings, a cylinder head of the internal combustion engine 1 is provided with intake valves that open and close intake ports and exhaust valves that open and close exhaust ports. The intake valves and the exhaust valves are disposed individually for the cylinders, and are opened and closed via camshafts. In a top portion of the cylinder head, ignition plugs 7 for igniting mixture in the combustion chambers 3 are attached separately for each cylinder.

The intake ports of the cylinders are connected to a surge tank 8 that is an intake collective chamber, via branch pipes 4 of the individual cylinders. An intake pipe 13 is connected to an upstream side of the surge tank 8. An upstream end of the intake pipe 13 is provided with an air cleaner 9. An air flow meter 5 for detecting the amount of intake air, and an electronically controlled throttle valve 10 are incorporated in the intake pipe 13 in that order from the upstream side. The intake ports, the branch pipes 4, the surge tank 8 and the intake pipe 13 substantially form an intake passageway.

Injectors (fuel injection valves) 12 that inject fuel into the intake passageway and, particularly, the intake ports, are provided separately for each cylinder. The fuel injected from each injector 12 is mixed with intake air to form a mixture that is taken into a corresponding one of the combustion chambers 3 when the intake valve is opened. Then, the mixture is compressed by the piston, and is ignited to burn by the ignition plug 7.

On the other hand, the exhaust ports of the cylinders are connected to an exhaust manifold 14. The exhaust manifold 14 is made up of branch pipes 14*a* that are provided separately for the cylinders and that form an upstream portion of the exhaust manifold 14, and an exhaust collective portion 14*b* that forms a downstream portion of the exhaust manifold 14. An exhaust pipe 6 is connected to a downstream side of the exhaust collective portion 14*b*. The exhaust ports, the exhaust manifold 14 and the exhaust pipe 6 substantially form an exhaust passageway.

In an upstream-side portion and a downstream-side portion of the exhaust pipe 6, there are provided an upstream catalyst 11 and a downstream catalyst 19, respectively, in series. Each of the catalysts 11 and 19 is made up of a three-way catalyst. These catalysts 11 and 19 have oxygen storage capability ($O_2$ storage capability). Specifically, each of the catalysts 11 and 19 stores excess oxygen in exhaust gas and reduces NOx when the air/fuel ratio of exhaust gas is greater (leaner) than a stoichiometric ratio (e.g., A/F=14.6). When the air/fuel ratio of exhaust gas is smaller (richer) than the stoichiometric ratio, the catalysts 11 and 19 release stored oxygen, and oxidize HC and CO.

At upstream and downstream sides of the upstream catalyst 11, there are disposed first and second air/fuel ratio sensors for detecting the air/fuel ratios of exhaust gas, that is, a pre-catalyst sensor 17 and a post-catalyst sensor 18. The pre-catalyst sensor 17 and the post-catalyst sensor 18 are disposed at positions immediately forward and immediately rearward of the upstream catalyst 11, and detect the air/fuel ratio on the basis of the oxygen concentration in exhaust gas. Thus, one catalyst-sensor 17 is disposed in an exhaust collective portion at the upstream side of the upstream catalyst 11. The upstream catalyst 11 corresponds to a "catalyst" in the invention, and the pre-catalyst sensor 17 corresponds to an "air/fuel ratio sensor" in the invention.

The ignition plugs 7, the throttle valve 10, the injectors 12, etc. that are mentioned above are electrically connected to an electronic control unit (hereinafter, termed the ECU) 20 that is a control portion. The ECU 20 includes a CPU, a ROM, a RAM, an input/output port, a storage device, etc. (none of which is shown). Furthermore, as shown in FIG. 1, the ECU 20 is electrically connected to the air flow meter 5, the pre-catalyst sensor 17, the post-catalyst sensor 18, and also to a crank angle sensor 16 that detects the crank angle of the internal combustion engine 1, an accelerator operation amount sensor 15 that detects the accelerator operation amount, and other various sensors, via A/D converters (not shown) and the like. The ECU 20 controls the ignition plugs 7, the throttle valve 10, the injectors 12, etc. and thereby controls the ignition timing, the fuel injection amount, the fuel injection timing, the throttle opening degree, etc., on the basis of detected values from the various sensors, and the like, so as to achieve a desired output.

The throttle valve 10 is provided with a throttle opening degree sensor (not shown), and a signal from the throttle opening degree sensor is sent to the ECU 20. The ECU 20 usually performs feedback control of controlling the degree of opening of the throttle valve 10 (throttle opening degree) to a target throttle opening degree that is determined according to the accelerator operation amount.

The ECU 20 detects the amount of intake air, that is, the intake air amount, per unit time, on the basis of a signal from the air flow meter 5. Then, the ECU 20 detects the load of the engine 1 on the basis of at least one of the detected accelerator operation amount, the detected throttle opening degree and the detected intake air amount.

The ECU 20, on the basis of a crank pulse signal from the crank angle sensor 16, detects the crank angle, and also detects the number of revolutions of the engine 1. Herein, the "number of revolutions" refers to the number of revolutions per unit time, and means the same as the rotation speed. In this embodiment, the number of revolutions refers to the number of revolutions per minute (rpm).

Figure 2:
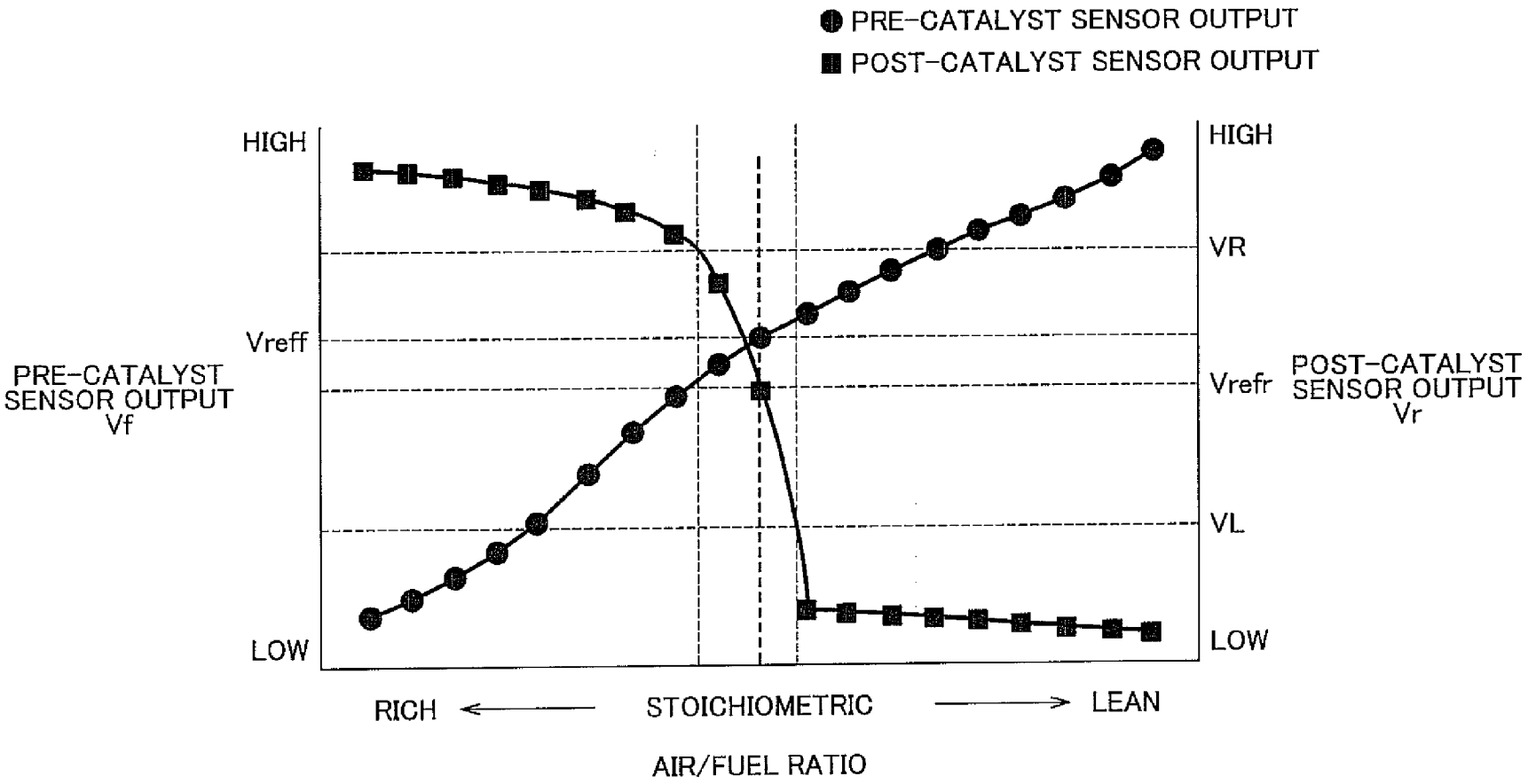
FIG. 2 is a graph showing output characteristics of a pre-catalyst sensor and a post-catalyst sensor in accordance with the embodiment.

The pre-catalyst sensor 17 is made up of a so-called wide-range air/fuel ratio sensor, and is capable of continuously detecting the air/fuel ratio over a relatively wide range. FIG. 2 shows an output characteristic of the pre-catalyst sensor 17. As shown in FIG. 2, the pre-catalyst sensor 17 outputs a voltage signal Vf whose magnitude is proportional to the exhaust air/fuel ratio. The output voltage that the pre-catalyst sensor 17 produces when the exhaust air/fuel ratio is stoichiometric is Vreff (e.g., about 3.3 V).

On the other hand, the post-catalyst sensor 18 is formed by a so-called $O_2$ sensor, and has a characteristic in which the output value of the sensor changes sharply in the vicinity of the stoichiometric ratio. FIG. 2 shows an output characteristic of the post-catalyst sensor 18. As shown in FIG. 2, the output voltage that the post-catalyst sensor 18 produces when the exhaust air/fuel ratio is stoichiometric, that is, a stoichiometric ratio-corresponding voltage value, is Vrefr (e.g., 0.45 V). The output voltage of the post-catalyst sensor 18 changes within a predetermined range (e.g., of 0 to 1 V). When the exhaust air/fuel ratio is leaner than the stoichiometric ratio, the output voltage of the post-catalyst sensor is lower than the stoichiometric ratio-corresponding voltage value Vrefr, and when the exhaust air/fuel ratio is richer than the stoichiometric ratio, the output voltage of the post-catalyst sensor is higher than the stoichiometric ratio-corresponding value Vrefr.

Each of the upstream catalyst 11 and the downstream catalyst 19 is capable of simultaneously removing NOx, HC and CO, which are pollutants in exhaust gas, when the air/fuel ratio A/F of the exhaust gas that flows into the catalyst is in the vicinity of the stoichiometric ratio. The width (window) of the air/fuel ratio in which the three pollutants can be simultaneously removed with high efficiency is relatively narrow.

Therefore, during usual operation of the engine 1, an air/fuel ratio feedback control (stoichiometric control) is executed by the ECU 20 so that the air/fuel ratio of the exhaust gas that flows into the upstream catalyst 11 is controlled to the vicinity of the stoichiometric ratio. The air/fuel ratio feedback control includes a main air/fuel ratio feedback control in which the exhaust air/fuel ratio detected by the pre-catalyst sensor 17 is caused to be equal to the stoichiometric ratio, which is a predetermined target air/fuel ratio, and an auxiliary air/fuel ratio feedback control in which the exhaust air/fuel ratio detected by the post-catalyst sensor 18 is caused to be equal to the stoichiometric ratio For example, in some cases, there occurs an event in which at least one of the cylinders (in particular, one cylinder) has an abnormality of any kind, and therefore variation in the air/fuel ratio (imbalance) among the cylinders occurs. An example of the event is a case where, for example, the fuel injection amount of the #1 cylinder becomes relatively large due to failure of injector 12 of the #1 cylinder, and therefore the air/fuel ratio of the #1 cylinder deviates greatly to the rich side of the air/fuel ratio of the #2, #3 and #4 cylinders. Even in this case, the air/fuel ratio of a total gas supplied to the pre-catalyst sensor 17 can sometimes be controlled to the stoichiometric ratio if a relatively large correction amount is given by the aforementioned air/fuel ratio feedback control. However, this is a state in which, in view of the individual cylinders, the air/fuel ratio of the #1 cylinder is greatly richer than the stoichiometric ratio, and the air/fuel ratio of each of the #2, #3 and #4 cylinders is slightly leaner than the stoichiometric ratio, and the stoichiometric ratio is obtained merely as an overall balance. Thus, it is apparent that this is not desirable in terms of exhaust emissions. Therefore, in this embodiment, there is provided a measure that prevents degradation of exhaust emissions even in the case where such an inter-cylinder air/fuel ratio variation occurs.

Figures 3A, 3B:
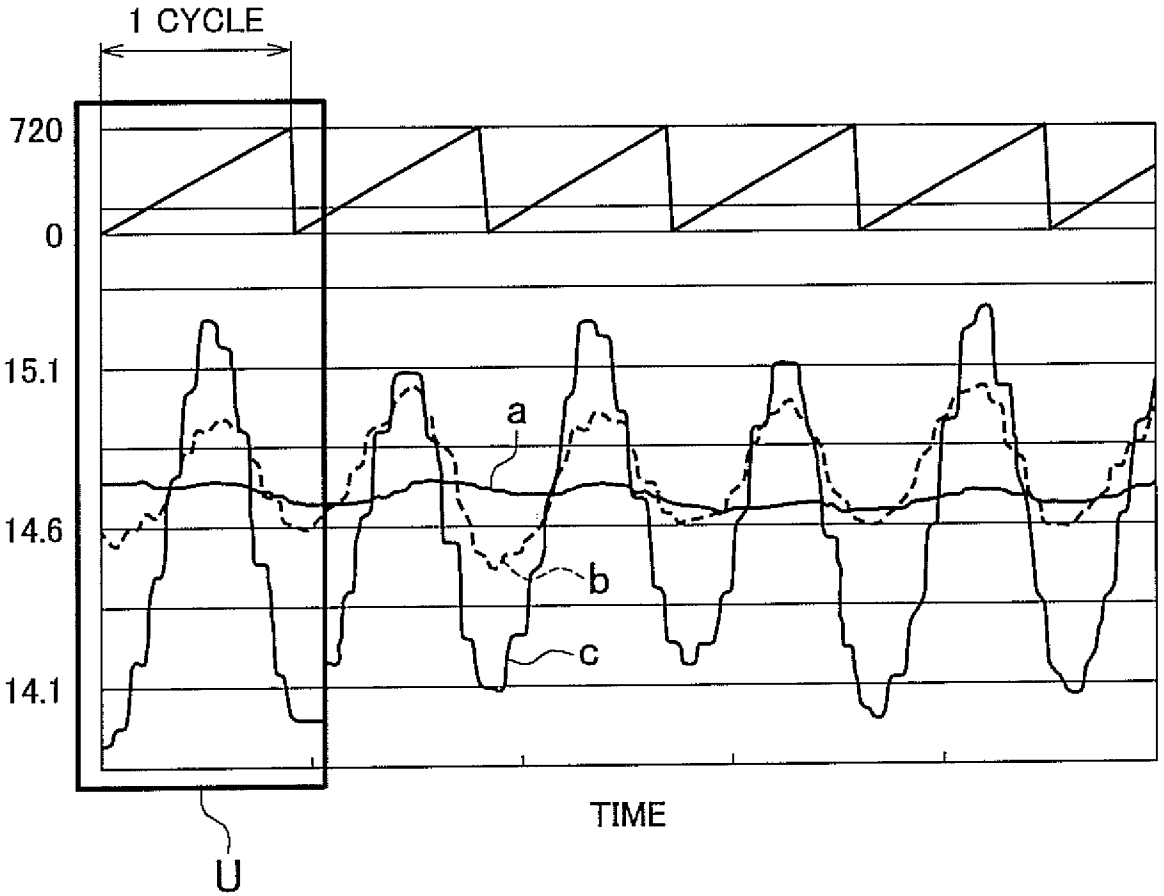
FIGS. 3A and 3B are graphs showing fluctuations of the exhaust air/fuel ratio commensurate with the degree of inter-cylinder air/fuel ratio variation in accordance with the embodiment.

As shown in FIGS. 3A and 3B, if an inter-cylinder air/fuel ratio variation occurs, the fluctuation of the exhaust air/fuel ratio in one engine cycle (=720° C.A) becomes large. In FIG. 3B, air/fuel ratio graphs a, b and c show the air/fuel ratios A/F detected by the pre-catalyst sensor 17 when there is no such inter-cylinder air/fuel ratio variation, when one cylinder alone has a rich deviation of 20% in imbalance proportion, and when one cylinder alone has a rich deviation of 50% in imbalance proportion, respectively. As can be seen in FIG. 3B, the greater the degree of inter-cylinder air/fuel ratio variation, the greater the amplitude of the air/fuel ratio fluctuation.

It is to be noted herein that the imbalance proportion (%) is a parameter that represents the degree of variation in air/fuel ratio among the cylinders. That is, the imbalance rate shows, in the case where only a certain one of all the cylinders has a deviation in the fuel injection amount, by what percentage the fuel injection amount of the cylinder having a fuel injection amount deviation (imbalance cylinder) is deviated from the fuel injection amount of each of the cylinders that do not have any fuel injection amount deviation (balance cylinders), that is, a reference fuel injection amount. The imbalance rate IB is expressed by $IB=(Qib-Qs)/Qs$ where Qib is the fuel injection amount of the imbalance cylinder and Qs is the fuel injection amount of the balance cylinders (i.e., the reference fuel injection amount). As the imbalance rate IB is greater, the fuel injection amount deviation of the imbalance cylinder relative to the balance cylinders is greater and the degree of variation in the air/fuel ratio is greater.

As can be understood from FIGS. 3A and 3B, as the imbalance proportion is greater, that is, as the degree of variation in air/fuel ratio among the cylinders is greater, the fluctuation of the output of the pre-catalyst sensor 17 is greater.

Hence, in this embodiment, by utilizing this characteristic, an output fluctuation parameter X that represents the degree of output fluctuation of the pre-catalyst sensor 17 is used as a parameter that represents the degree of inter-cylinder air/fuel ratio variation, and the output fluctuation parameter X is detected. The aforementioned imbalance proportion is used for the purpose of description.

(Detection of Output Fluctuation Parameter)

Figures 4A, 4B:
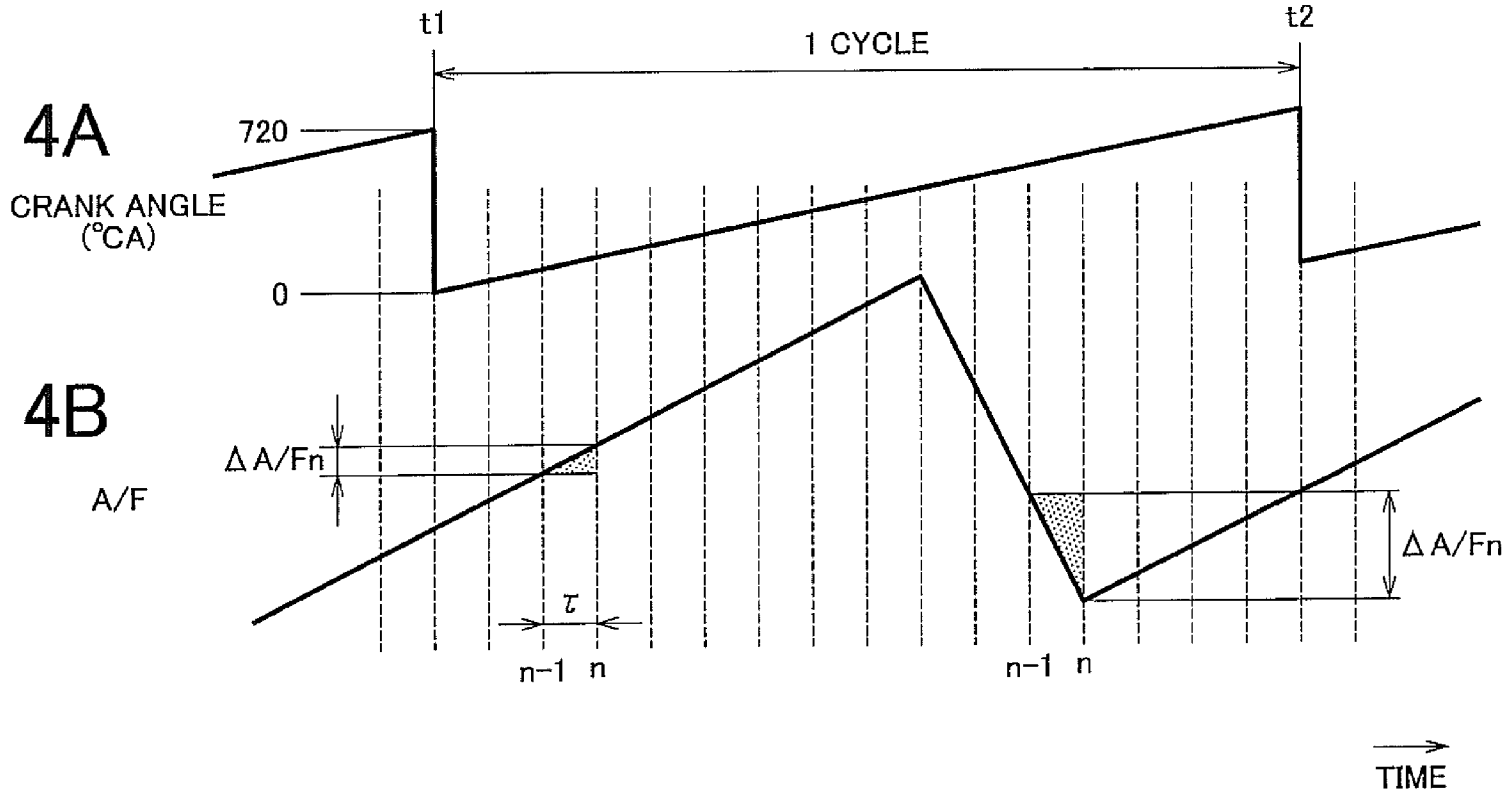
FIG. 4A is enlarged diagram that corresponds to a portion U of FIG. 3A.
FIG. 4B is enlarged diagram that corresponds to a portion U of FIG. 3B.

A detection method for an output fluctuation parameter X will be described below. FIGS. 4A and 4B are enlarged diagrams of portions that correspond to a portion U in FIGS. 3A and 3B, showing particularly fluctuations of the output of the pre-catalyst sensor within one engine cycle in a simplified manner. As the pre-catalyst sensor output, a value of the air/fuel ratio A/F converted from the output voltage Vf of the pre-catalyst sensor 17 is used. However, the output voltage Vf of the pre-catalyst sensor 17 may also be directly used.

As shown in FIG. 4B, the ECU 20 acquires a value of the pre-catalyst sensor output A/F at every predetermined sampling period (unit time, e.g., 4 ms) within one engine cycle. Then, the absolute value of a difference $\Delta A/F_{n-1}$ between the value $A/F_n$ acquired at the present timing (second timing) and the value $A/F_{n-1}$ acquired at the previous timing (first timing) is found by the following expression (1). This difference $\Delta A/F_n$ can also be referred to as a differential value or a slope at the present timing.

$$\Delta A/F_u = |A/F_u - A/F_{n-1}| \quad (1)$$

Most simply, the difference $\Delta A/F_n$ represents fluctuations of the pre-catalyst sensor output. As the degree of fluctuation is greater, the slope of the air/fuel ratio graph is greater and the difference $\Delta A/F_n$ is greater. The difference $\Delta A/F_n$ at a predetermined timing can be used as an output fluctuation parameter.

However, in this embodiment, an average value of a plurality of differences $\Delta A/F_n$ is used as the output fluctuation parameter in order to improve accuracy. In this embodiment, the difference $\Delta A/F_n$ is accumulated at every timing during one engine cycle, and the final accumulated value is divided by the number N of samples to obtain an average value of differences $\Delta A/F_n$ in one engine cycle. Then, the average values of differences $\Delta A/F_n$ in M number of engine cycles (e.g., M=100) are accumulated, and the final accumulated value is divided by the number M of engine cycles to find an average value of differences $\Delta A/F_n$ in M number of engine cycles. The final average value found in this manner is set as an output fluctuation parameter X. The output fluctuation parameter X is greater as the degree of fluctuation of the pre-catalyst sensor output is greater.

Incidentally, since the pre-catalyst sensor output A/F increases in a case and decreases in another case, the difference $\Delta A/F_n$ or the average value thereof may be found with regard to only one of the two cases, and the difference $\Delta A/F_n$ or the average value may be used as an output fluctuation parameter. In particular, in the case of rich deviation of one cylinder alone, the output of the pre-catalyst sensor rapidly changes to the rich side (i.e., sharply decreases) when the pre-catalyst sensor receives the exhaust gas that corresponds to that cylinder of rich deviation, and therefore it is also possible to use only values on the decrease side for the purpose of detecting rich deviation. However, this is not restrictive, and the use of only values on the increase side is also possible.

Furthermore, any value that correlates with the degree of fluctuation of the pre-catalyst sensor output can be used as an output fluctuation parameter. For example, an output fluctuation parameter can also be calculated on the basis of a difference between a maximum peak and a minimum peak (generally termed peak-to-peak difference) of the pre-catalyst sensor output in one engine cycle, or the absolute value of a maximum peak or a minimum peak of the second order differential value. This is because as the degree of fluctuation of the pre-catalyst sensor output is greater, the difference between the maximum peak and the minimum peak of the pre-catalyst sensor output is greater, and the absolute value of the maximum peak or the minimum peak of the second order differential value is also greater.

Figure 5:
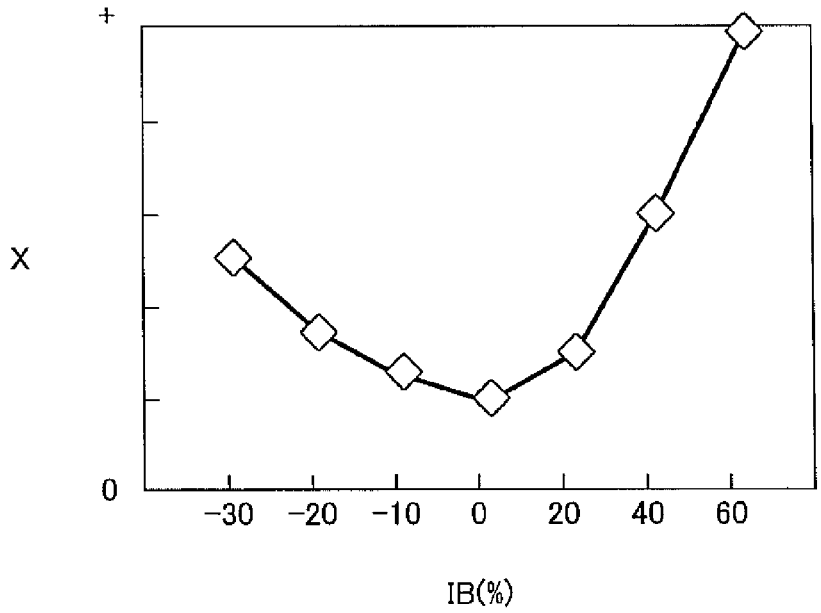
FIG. 5 is a graph showing a relation between the imbalance proportion and an output fluctuation parameter in accordance with the embodiment.

FIG. 5 shows a relation between the imbalance proportion IB (%) and the output fluctuation parameter X. As shown in FIG. 5, the imbalance proportion IB and the output fluctuation parameter X have a strong correlation, in which as the absolute value of the imbalance proportion IB increases, the air/fuel ratio fluctuation parameter X increases.

Incidentally, it is possible to detect an inter-cylinder air/fuel ratio variation abnormality on the basis of the detected value of the output fluctuation parameter X. Specifically, if the detected value of the output fluctuation parameter X is greater than or equal to a predetermined abnormality criterion value, it is determined that there is variation abnormality. If the detected value of the output fluctuation parameter X is less than the abnormality criterion value, it is determined that there is no abnormality, that is, the present state is normal.

(Rich Control)

In the embodiment, when it is detected that the output fluctuation parameter X is greater than or equal to a predetermined value, that is, when it is detected that the degree of variation in air/fuel ratio among the cylinders is great, a rich control for enriching the air/fuel ratio is executed on condition that a predetermined condition is satisfied.

If the air/fuel ratio of one cylinder alone deviates greatly from the stoichiometric ratio to the rich side, the rich-deviation cylinder discharges a relatively large amount of hydrogen. Due to the influence of the hydrogen, the output of the pre-catalyst sensor 17 deviates to the rich side of the true air/fuel ratio (see JP 2009-30455 A).

If, in such a state, the stoichiometric control is performed in a usual manner, the actual air/fuel ratio of total gas deviates to the lean side of the stoichiometric ratio, giving rise to possibility of increase in the amount of NOx emissions.

Hence, as a countermeasure against this, the foregoing rich control is performed. Due to this control, the actual lean deviation of total gas is restrained or offset, so that the increase in the amount of NOx emissions can be restrained.

Hereinafter, the rich control will be described in detail. In a first example, when the rich control is performed, the target air/fuel ratio A/Ft in the above-described air/fuel ratio feedback control is enriched.

That is, the target air/fuel ratio A/Ft of the usual air/fuel ratio feedback control is the stoichiometric ratio (=14.6). However, the target air/fuel ratio A/Ftr of the rich control is a value that is richer (smaller) than the stoichiometric ratio. The target air/fuel ratio A/Ftr of the rich control is calculated by the following expression (2):

$$A/Ftr = 14.6 - \alpha \quad (2)$$

In the expression (2), $\alpha$ is a rich-correction amount for correcting the target air/fuel ratio. The rich-correction amount $\alpha$ may be a constant value (e.g., 0.4). In this embodiment, however, the rich-correction amount $\alpha$ is variably set within a predetermined range (e.g., of 0.2 to 0.6) according to at least the load KL and, concretely, according to the load KL, the number of revolutions Ne and the output fluctuation parameter X.

Figure 6:
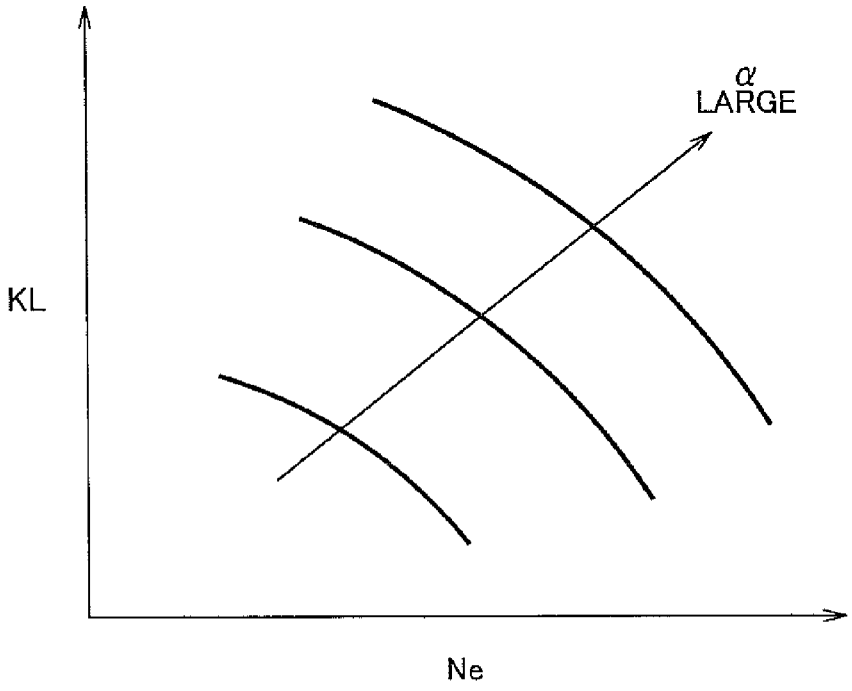
FIG. 6 is a graph showing a relation between the load, the number of revolutions and the amount of rich correction in accordance with the embodiment.

FIG. 6 shows a relation among the load KL, the number of revolutions Ne and the rich-correction amount $\alpha$. The larger the load KL and/or the number of revolutions Ne is, the larger the rich-correction amounts $\alpha$ is set. As the load KL and/or the number of revolutions Ne is larger, the amount of hydrogen discharged from the rich deviation cylinder becomes larger, and the actual lean deviation amount of total gas becomes greater. Therefore, in accordance with this characteristic, as the load KL and/or the number of revolutions Ne is larger, the rich-correction amount $\alpha$ is set larger, and therefore the degree of enrichment is made larger.

Figure 7:
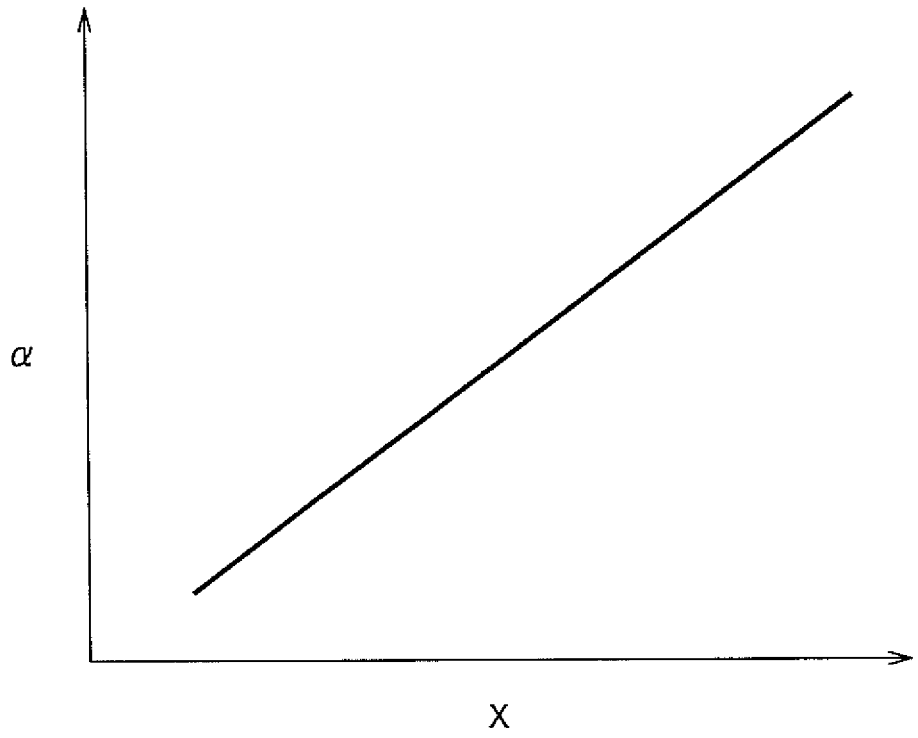
FIG. 7 is a graph showing a relation between the output fluctuation parameter and the amount of rich correction in accordance with the embodiment.

FIG. 7 shows a relation between the output fluctuation parameter X and the rich-correction amount $\alpha$. The larger the output fluctuation parameter X is, the larger the rich-correction amount $\alpha$ is set. As the output fluctuation parameter X is larger, the degree of rich deviation of the rich-deviation cylinder increases, and the amount of hydrogen discharged from the rich-deviation cylinder becomes larger and the actual lean-deviation amount of total gas becomes greater. Therefore, in accordance with this characteristic, as the output fluctuation parameter X is larger, the rich-correction amount $\alpha$ is set larger, and therefore the degree of enrichment is made larger.

Incidentally, in reality, the rich-correction amount $\alpha$ is set on the basis of various detected values through the use of a map (that may be replaced with a function, which applies in the following description) in which the above-described relation is defined.

Next, a second example will be described. In the second example, when the rich control is performed, the fuel injection amount in the above-described air/fuel ratio feedback control is enriched.

That is, in the usual air/fuel ratio feedback control, for example, the final fuel injection amount Qfnl injected from an injector 12 is calculated by the following expression (3):

$$Qfnl=Kf\times Qb+Kr \quad (3)$$

In the expression (3), Qb is a basic injection amount, and is calculated, for example, on the basis of the intake air amount Ga detected by the air flow meter 5, by using an expression Qb=Ga/14.6. Furthermore, Kf is a main air/fuel ratio feedback correction amount, and is calculated on the basis of a difference between the air/fuel ratio detected by the pre-catalyst sensor 17 (detected air/fuel ratio) and the stoichiometric ratio. Kr is an auxiliary air/fuel ratio feedback correction amount, and is a learned value that is calculated on the basis of the output of the post-catalyst sensor 18.

In the rich control, the final fuel injection amount Qfnl to be injected from each injector 12 is calculated by the following expression (3)'.

$$Qfnl=Kf\times Qb+Kr+\beta \quad (3)'$$

In the expression (3)', $\beta$ is a rich-correction amount for correcting the fuel injection amount. As is apparent from the expression, the amount of fuel injection is increased simply by the amount $\beta$. Similarly to the rich-correction amount $\alpha$, the rich-correction amount may be a constant value; however, in this embodiment, the rich-correction amount $\beta$ is variably set within a predetermined range, according to at least the load KL (concretely, the load KL, the number of revolutions Ne and the output fluctuation parameter X).

Also similarly to what is described above in conjunction with the rich-correction amount $\alpha$, as the load KL and/or the number of revolutions Ne is larger, the rich-correction amount $\beta$ is set larger, and as the output fluctuation parameter X is larger, the rich-correction amount $\beta$ is set larger. Furthermore, the rich-correction amount $\beta$ is set by using a predetermined map, similarly to the rich-correction amount $\alpha$.

In the first and second examples and the like, the rich control is executed at least when the load KL of the engine is greater than or equal to a predetermined value. Particularly in the embodiment, the rich control is executed when the load KL and the number of revolutions Ne of the engine are greater than or equal to their respective predetermined values.

The rich deviation of the pre-catalyst sensor output due to hydrogen in exhaust gas, and the increase in the NOx emission amount caused by the rich deviation occur in an operation region in which the load KL of the engine is greater than or equal to the predetermined value and, in particular, a region in which the load KL and the number of revolutions Ne of the engine are greater than or equal to their respective predetermined values. Hence, the rich control is performed only in this operation region, and the rich control is not performed in the other operation regions. Due to this, the operation region in which the rich control is performed is limited to an operation region in which the rich control is needed, and the emission deterioration due to unnecessary rich control can be prevented.

Hereinafter, the operation region in which the rich control is performed is termed the enrichment region. It is assumed that the rich control is performed as in the first example: unless otherwise mentioned in particular.

(Execution/Stop of Rich Control)

According to results of researches by the present inventors, it has turned out that if the rich control is continued in the enrichment region, it can happen that the enrichment becomes excessive and the amount of HC emissions increases.

Figure 8A:
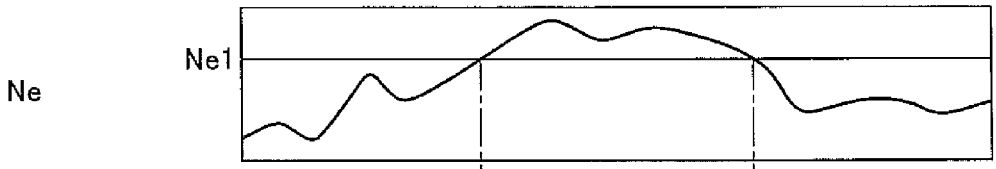
FIGS. 8A to 8E are time charts showing a comparative example.
Figure 8B:
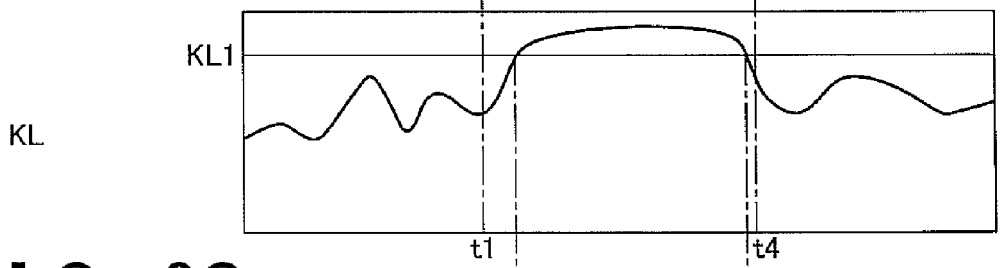
Figure 8C:
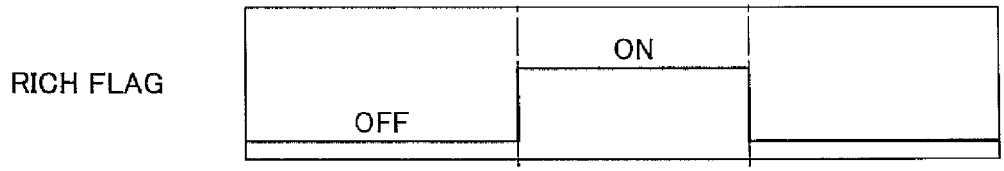
Figure 8D:
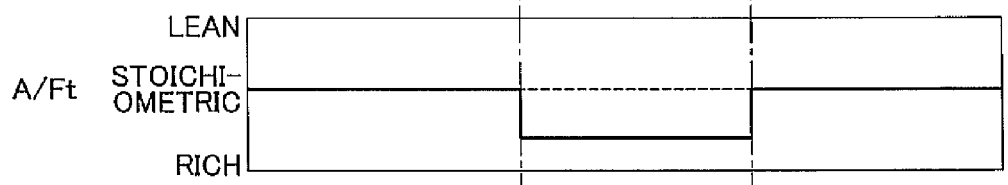
Figure 8E:
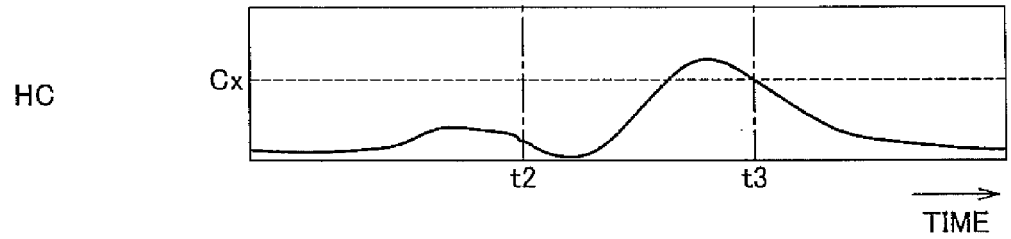

FIGS. 5A to 8E show a comparative example in which the invention is not applied. FIG. 8A shows the number of engine revolutions Ne, and FIG. 8 shows the engine load KL, and FIG. 8C shows a rich flag, and FIG. 8D shows the target air/fuel ratio A/Ft, and FIG. 8E shows the amount of HC emissions. The rich flag is a flag that is turned on when the operation state of the engine enters the enrichment region, and that is turned off when the operation state of the engine departs from the enrichment region. The amount of HC emissions shown in FIG. 8E means the amount of HC discharged from the upstream catalyst 11.

As shown in the drawings, the number of revolutions Ne becomes greater than or equal to a predetermined value Net at time t1, and the load KL becomes greater than or equal to a predetermined value KL1 at time t2. At time t2, the operation state of the engine enters the enrichment region, and the rich flag is turned on, and the rich control is started. The rich control is continued until the load KL becomes less than the predetermined value KL1 at time t3, that is, until the operation state of the engine departs from the enrichment region. Then, at time t4, the number of revolutions Ne also becomes less than the predetermined value Ne1. In this comparative example, the turning on and the turning off of the rich flag correspond to the execution and the stop of the rich control, respectively.

During the rich control, the target air/fuel ratio of the air/fuel ratio feedback control is enriched, and the target air/fuel ratio is set richer than the stoichiometric ratio.

In the latter half of the continuation of the rich control, the amount of HC emissions is greater than a threshold value Cx that is a predetermined permissible upper-limit value. This means that the enrichment is excessive, and therefore the amount of HC emissions has increased.

In particular, the present inventors have discovered that a cause of the increase in the amount of HC emissions is that the rich control is continued although the upstream catalyst 11 has released the entire amount of stored oxygen.

That is, the enrichment in the rich control is carried out at a level that is considered to be steadily proper through adaptation. However, in reality, partly because the operation state changes all the time, the exhaust air/fuel ratio tends to be rich a region of relative high load, such as the enrichment region, even when the enrichment is not performed. Then, the oxygen stored in the upstream catalyst 11 is gradually released, and therefore decreases to an amount that is insufficient to process the HC, in the course of time. When such a time point comes, the amount of HC emissions begins to increase.

Therefore, on the basis of these findings, the embodiment measures or monitors the amount of oxygen stored in the upstream catalyst 11, and executes or stops the rich control according to the stored oxygen amount. This will be described in detail below.

Figures 9A, 9B, 9C, 9D, 9E, 9F, 9G:
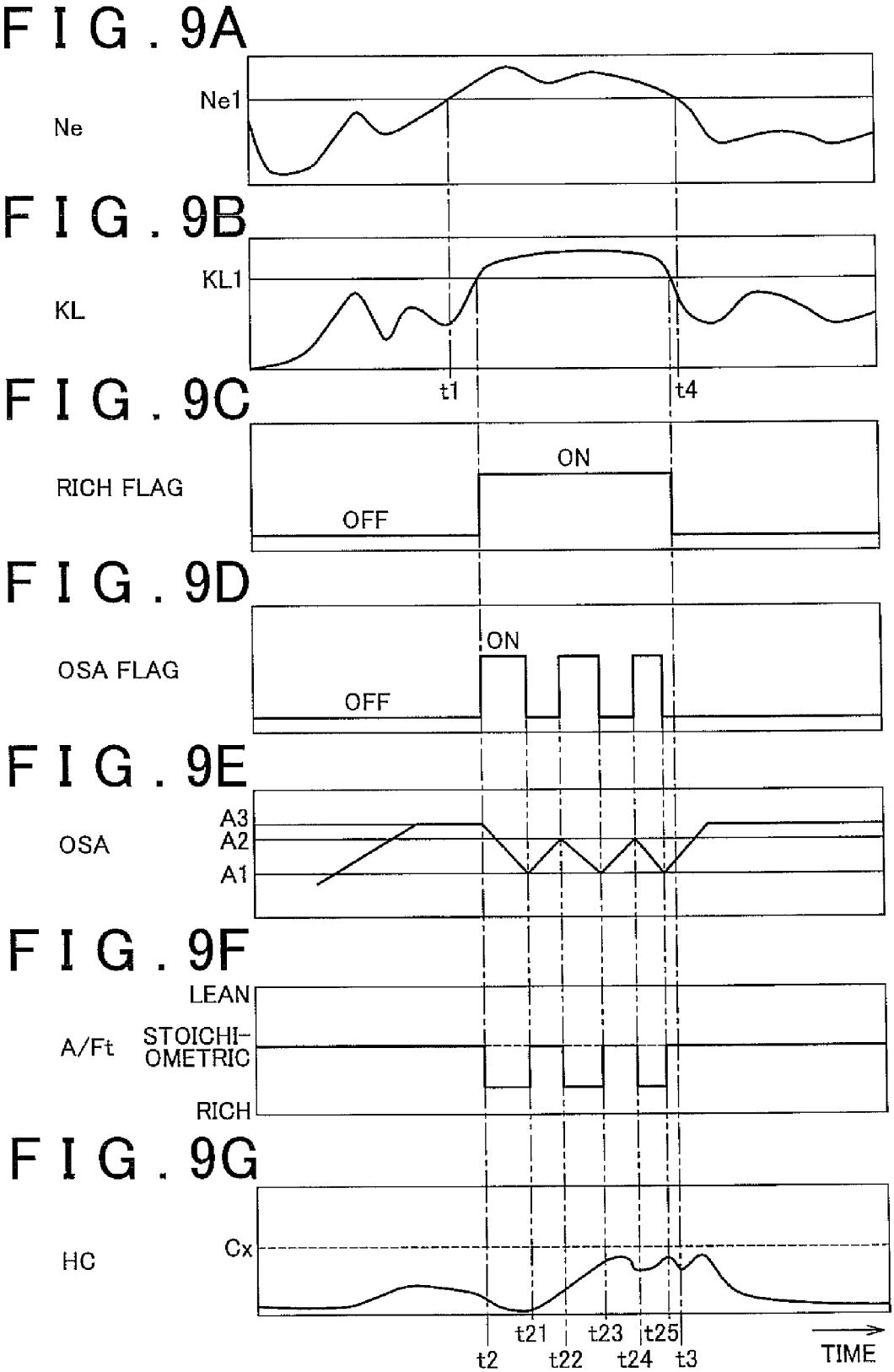
FIGS. 9A to 9G are time charts showing an embodiment of the invention.

FIGS. 9A to 9G show an example of the embodiment to which the invention is applied. FIG. 9A shows the number of engine revolutions Ne, and FIG. 9B shows the engine load KL, and FIG. 9C shows the rich flag, and FIG. 9D shows an OSA flag, and FIG. 9E shows the stored oxygen amount OSA, and FIG. 9F shows the target air/fuel ratio A/Ft, and FIG. 9G shows the amount of HC emissions. The stored oxygen amount OSA means the amount of oxygen stored in the upstream catalyst 11. The OSA flag is a flag that is turned on and off according to the value of the stored oxygen amount OSA.

In this example, the turning on and the turning off of the rich flag do not necessarily correspond to the execution and the stop of the rich control. That is, when the rich flag is on and the OSA flag is on, the rich control is executed, and at the other times, the rich control is stopped. During stop of the rich control (i.e., a usual time), the above-described stoichiometric control is executed.

This example is the same as the above-described comparative example in that during the period of time t2 to time t3, the operation state of the engine is in the enrichment region, and that during this period, the rich flag is on. However, in the example shown in FIGS. 9A to 9G, during the period of time t2 to time t3, the OSA flag is turned on and off and the rich control is executed and stopped according to the stored oxygen amount OSA. That is, even in the revolution/load condition in which the rich control is continued in the comparative example, it can happen in the example that the rich control is temporarily stopped or the rich control is performed intermittently.

The rich control is executed or stopped so that the measured value of the stored oxygen amount OSA does not become less than a predetermined lower-limit threshold value A1. Concretely, when during execution of the rich control, the measured value of the stored oxygen amount OSA decreases, and reaches the lower-limit threshold value A1 (time t21, t23, t25), the OSA flag is turned off and the rich control is stopped (i.e., a rich cut is executed). When during stop of the rich control, the measured value of the stored oxygen amount OSA increases, and reaches a predetermined upper-limit threshold value A2 (time t22, t24), the OSA flag is turned on and the rich control is resumed. The lower-limit threshold value A1 is, for example, 100 (g), and the upper-limit threshold value A2 is, for example, 300 (g).

As described above, the rich control is executed or stopped so that the stored oxygen amount OSA does not become less than the lower-limit threshold value A1, and when the stored oxygen amount OSA reaches the predetermined lower-limit threshold value A1, the rich control is stopped. Therefore, excessive enrichment can be prevented, and the rich control can be stopped before the oxygen stored in the upstream catalyst 11 is completely released. During the second half of the period of time t2 to time t3, too, it is possible to prevent the amount of HC emissions from exceeding the threshold value Cx as shown in FIG. 9G. Hence, it is possible to avoid an oxygen shortage state in which the upstream catalyst 11 cannot process HC, and to restrain increases in the amount of HC emissions. From the viewpoint of this, the lower-limit threshold value A1 is set at such a value that a minimum required level of the HC processing capability of the upstream catalyst 11 can be secured.

Furthermore, since the rich control is resumed when the stored oxygen amount OSA reaches the upper-limit threshold value A2, the restraint of NOx, which is the original purpose of the rich control, can also be achieved.

(Measurement of Stored Oxygen Amount)

The measurement of the stored oxygen amount OSA of the upstream catalyst 11 will be described. Firstly, at the time of the air/fuel ratio feedback control other than the rich control, the stored oxygen amount dOSA at every predetermined computation cycle is calculated by the following expression (4).

$$dOSA = \frac{AF1 - 14.6}{AF1} \times Ga \times B \tag{4}$$

In the expression (4), AF1 is a usual-time virtual air/fuel ratio, and is a value (e.g., 15.0) that is leaner than the stoichiometric ratio (14.6). Furthermore, B is a coefficient found through adaptation, and is, for example, 3.77. Ga is the intake air amount.

The usual-time virtual air/fuel ratio AF1 is set so as to reflect the actual value of the exhaust air/fuel ratio occurring at the time of execution of the air/fuel ratio feedback control. Specifically, when one cylinder alone has rich deviation, the actual exhaust air/fuel ratio is leaner than the stoichiometric ratio although the control is performed so that the detected air/fuel ratio provided by the pre-catalyst sensor 17 becomes equal to the stoichiometric ratio. Furthermore, the detected air/fuel ratio provided by the pre-catalyst sensor 17 itself is inaccurate. Therefore, the stored oxygen amount dOSA at every computation cycle is calculated as a fixed value of the actual exhaust air/fuel ratio (AF1=15.0) occurring during execution of the air/fuel ratio feedback control. However, the usual-time virtual air/fuel ratio AF1 may be set on the basis of the detected air/fuel ratio provided by the pre-catalyst sensor 17.

The stored oxygen amount dOSA at every computation cycle is added up at every computation cycle, so that the stored oxygen amount OSA at every computation timing can be calculated or measured. In the expression (4), since (AF1−14.6)>0, the value of the stored oxygen amount OSA increases during the air/fuel ratio feedback control. This can be seen in the periods of t21 to t22 and t23 to t24 and the period from t25 on in FIG. 9E.

Next, during execution of the rich control, a stored oxygen amount dOSA at every computation cycle is calculated by the following expression (5).

$$dOSA = \frac{AF2 - 14.6}{AF2} \times Ga \times B \tag{5}$$

In the expression (5), AF2 is a rich-time virtual air/fuel ratio, and is set at a value that is richer than the stoichiometric ratio (14.6) and, particularly, at a value equal to the target air/fuel ratio A/Ftr of the rich control. Although the rich-time virtual air/fuel ratio AF2 may be a constant value (e.g., 14.2), the rich-time virtual air/fuel ratio AF2 in this embodiment is variably set in a predetermined range (e.g., of 14.0 to 14.4) according to at least the load KL (concretely, the load KL, the number of revolutions Ne and the output fluctuation parameter X). This rich-time virtual air/fuel ratio AF2, too, is set so as to reflect the actual value of the exhaust air/fuel ratio occurring during execution of the rich control.

In the expression (5), since (AF2−14.6)<0, the value of the stored oxygen amount OSA decreases during the rich control. This can be seen in periods of t2 to t21, t22 to t23 and t24 to t25 in FIG. 9E.

During execution of a fuel-cut (F/C) control in which the fuel injection is stopped, the stored oxygen amount dOSA at every computation cycle is calculated by the following expression (6).

$$dOSA = Ga \times B \quad (6)$$

As is apparent from the expression (6), the value of the stored oxygen amount OSA sharply increases during the F/C control.

The example shown in FIGS. 9A to 9G will be further described in detail. Firstly, before time t2 when the rich flag turns on, the usual air/fuel ratio feedback control is executed. At this time, the value of the stored oxygen amount OSA gradually increases, and after the amount OSA reaches a predetermined maximum oxygen amount A3, the amount OSA is kept at the value A3. That is, the measured value of the stored oxygen amount OSA does not exceed the maximum oxygen amount A3. The maximum oxygen amount A3 is, for example, 500 (g).

When the rich flag turns on at time t2 following the above-described state, the OSA flag is turned on (which will be detailed later) since the value of the stored oxygen amount OSA is greater than the lower-limit threshold value A1, so that the rich control is started.

After the rich control starts, the value of the stored oxygen amount OSA gradually decreases, and reaches the lower-limit threshold value A1 at time t21. Then, the OSA flag is turned of and the rich control is stopped, and the usual air/fuel ratio feedback control is started.

After the rich control is stopped, the value of the stored oxygen amount OSA gradually increases, and reaches the upper-limit threshold value A2 at time t22. Then, the OSA flag is turned on, and the usual air/fuel ratio feedback control is stopped, and the rich control is resumed.

Thus, the turning on and off of the OSA flag has a hysteresis characteristic. That is, while the stored oxygen amount OSA is decreasing, the OSA flag is turned on when OSA=A1 is reached. On the other hand, while the stored oxygen amount OSA is increasing, the OSA flag is turned off when OSA=A2 is reached.

The execution and the stop of the rich control as described above are repeated, and the rich flag is turned off at time t3. Simultaneously, the OSA flag is also turned off, and the usual air/fuel ratio feedback control is executed. On the other hand, the measurement of the stored oxygen amount OSA is executed also when the rich flag is off. After time t3, the value of the stored oxygen amount OSA gradually increases, and, in due time, reaches the maximum oxygen amount A3, at which the stored oxygen amount OSA is subsequently kept.

(Output Fluctuation Parameter Detecting Routine)

Next, a routine for detecting the output fluctuation parameter X will be described with reference to FIG. 10. Execution of this routine by the ECU 20 is repeated at every predetermined computation cycle τ.

Firstly, in step S101, it is determined whether a predetermined prerequisite suitable for executing the detection of the output fluctuation parameter X is satisfied. This prerequisite is satisfied, for example, when the following first to fifth conditions are satisfied. First condition is that the warm-up of the engine has been completed. Herein, the ECU 20 determines that the warm-up of the engine has been completed when the engine coolant temperature detected by an engine coolant temperature sensor (not shown) is higher than or equal to a predetermined value (e.g., 75° C.). Second condition is that the pre-catalyst sensor 17 and the post-catalyst sensor 18 have been activated. Herein, the ECU 20 determines that the two sensors have been activated when the impedance of each sensor is equal to a value that corresponds to a predetermined activation temperature of the sensor. Third condition is that the upstream catalyst 11 and the downstream catalyst 19 have been activated. Herein, the ECU 20 determines that the two catalysts have been activated when the temperature of each of the upstream catalyst 11 and the downstream catalyst 19 estimated on the basis of the operation state of the engine is equal to a value that corresponds to a predetermined activation temperature of the catalyst. Fourth condition is that the engine is steadily operating. Herein, the ECU 20 determines that the engine is steadily operating when the widths of fluctuation of the number of revolutions Ne and the load KL of the engine within a predetermined time are less than or equal to their respective predetermined values. Fifth condition is that the usual air/fuel ratio feedback control is being executed.

If the prerequisite is not satisfied in step S101, the routine is ended. On the other hand, if the prerequisite is satisfied, the pre-catalyst sensor output $A/F_n$ at the present timing is acquired in step S102. The pre-catalyst sensor output $A/F_n$ is a value of air/fuel ratio converted from the output voltage Vf of the pre-catalyst sensor 17.

Next, in step S103, the output difference $\Delta A/F_n$ at the present computation timing is calculated by the foregoing expression (1).

Next, in step S104, the output difference $\Delta A/F_n$ is added to the accumulated value, specifically, an accumulated output difference $\Sigma\Delta A/F_n$ at the present timing is calculated by the following expression (7).

$$\Sigma\Delta A/F_n = \Sigma A/F_{n-1} + \Delta A/F_n \quad (7)$$

Next, in step S105, it is determined whether one engine cycle has ended. If one engine cycle has not ended, the routine is ended. If one engine cycle has ended, the process proceeds to step S106.

In step S106, a final accumulated output difference $\Sigma\Delta A/F_N$ at the time point of the present end of one engine cycle is averaged by dividing it by the number N of samples, so that an average output difference $R_m$ is calculated.

Then, in step S107, the average output difference Rm is added to the accumulated value, that is, an accumulated average output difference $\Sigma R_m$ at the time of the present end of one engine cycle is calculated by the following expression (8).

$$\Sigma R_m = \Sigma R_{m-1} + R_m \quad (8)$$

Next, in step S108, it is determined whether M number of engine cycles (where M is an integer greater than or equal to 2) have ended. If not, the routine is ended. If M engine cycles have ended, the process proceeds to step S109.

In step S109, a final accumulated average output difference $\Sigma R_M$ at the time point of end of the M engine cycles is averaged by dividing it by the number M of cycles, whereby an output fluctuation parameter X is calculated. The thus-calculated output fluctuation parameter X is set as an output fluctuation parameter X that is a final detected value.

(Stored Oxygen Amount Measurement Routine)

Figure 11:
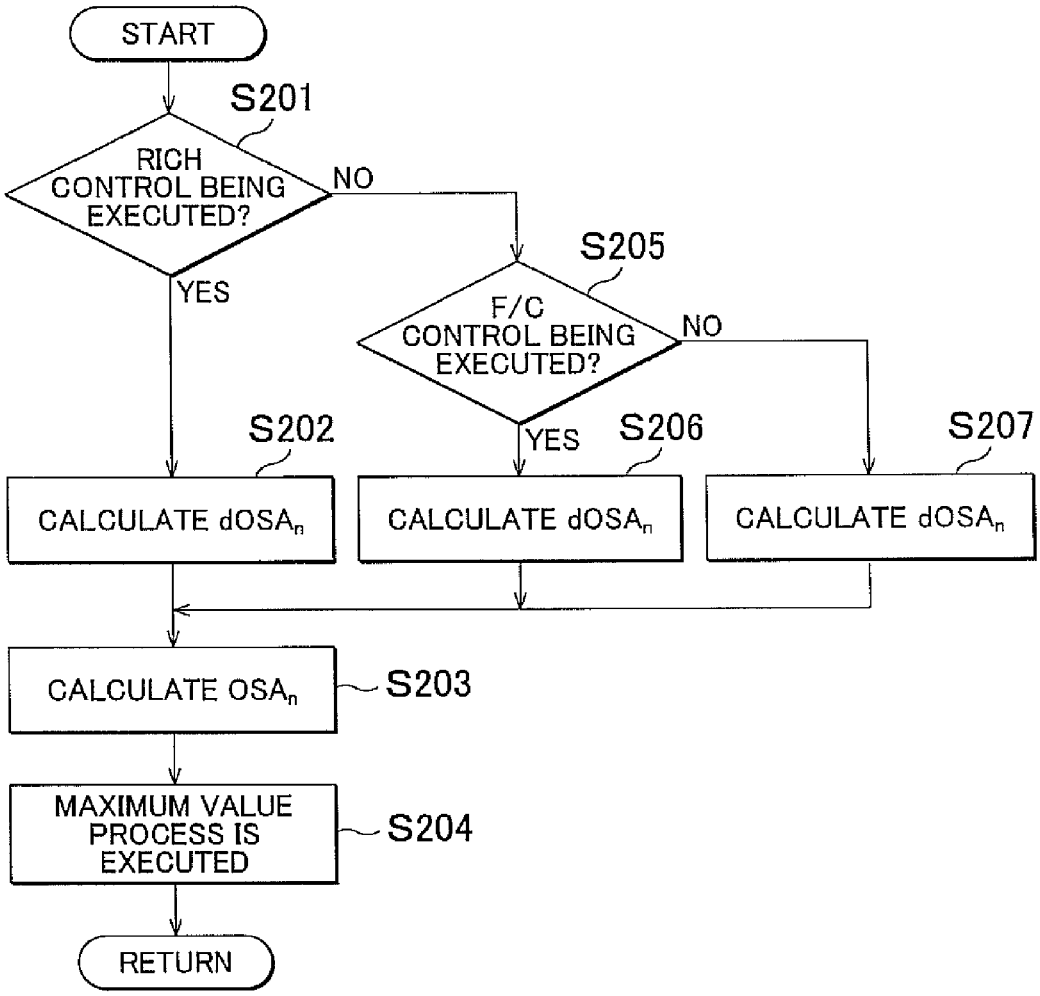
FIG. 11 is a flowchart of a stored oxygen amount measurement routine in accordance with the embodiment.

Next, a routine for measuring the stored oxygen amount OSA will be described with reference to FIG. 11. Execution of this routine is also repeated by the ECU 20 at every predetermined computation cycle τ.

In step S201, it is determined whether the rich control is being executed. If the rich control is being executed, the process proceeds to step S202, in which an individual-computation-cycle stored oxygen amount $dOSA_n$ at the present computation timing is calculated by the foregoing expression (5).

Next, in step S203, a stored oxygen amount $OSA_n$ at the present computation timing is calculated by the following expression (9).

$$OSA_n = OSA + dOSA_n \quad (9)$$

In the expression (9), n represents the present value, and n−1 represents the previous value. From the expression (9), it can be understood that the present stored oxygen amount $OSA_n$ is calculated by adding the present individual-computation-cycle stored oxygen amount $dOSA_n$ to the previous stored oxygen amount $OSA_{n-1}$.

Next, in step S204, a maximum value process is executed. That is, when the present stored oxygen amount $OSA_n$ calculated in step S203 is less than or equal to the aforementioned maximum oxygen amount A3 shown in FIG. 9E, the present stored oxygen amount $OSA_n$ is set as a final measured value of the stored oxygen amount OSA. On the other hand, when the present stored oxygen amount $OSA_n$ calculated in step S203 is greater than the maximum oxygen amount A3, the maximum oxygen amount A3 is set as a final measured value of the stored oxygen amount OSA.

If in step S201 it is determined that the rich control is not being executed, the process proceeds to step S205, in which it is determined whether the F/C control is being executed. If the F/C control is being executed, the process proceeds to step S206, in which the individual-computation-cycle stored oxygen amount $dOSA_n$ at the present computation timing is calculated by the foregoing expression (6). After that, steps S203 and S204 are executed in substantially the same manners as described above.

If in step S205 it is determined that the F/C control is not being executed, the process proceeds to step S207, in which it is substantially determined that the usual air/fuel ratio feedback control is being executed, and the individual-computation-cycle stored oxygen amount $dOSA_n$ at the present computation timing is calculated by the aforementioned expression (4). After that, steps S203 and S204 are executed in substantially the same manners as described above.

(OSA Flag Process)

Figure 12:
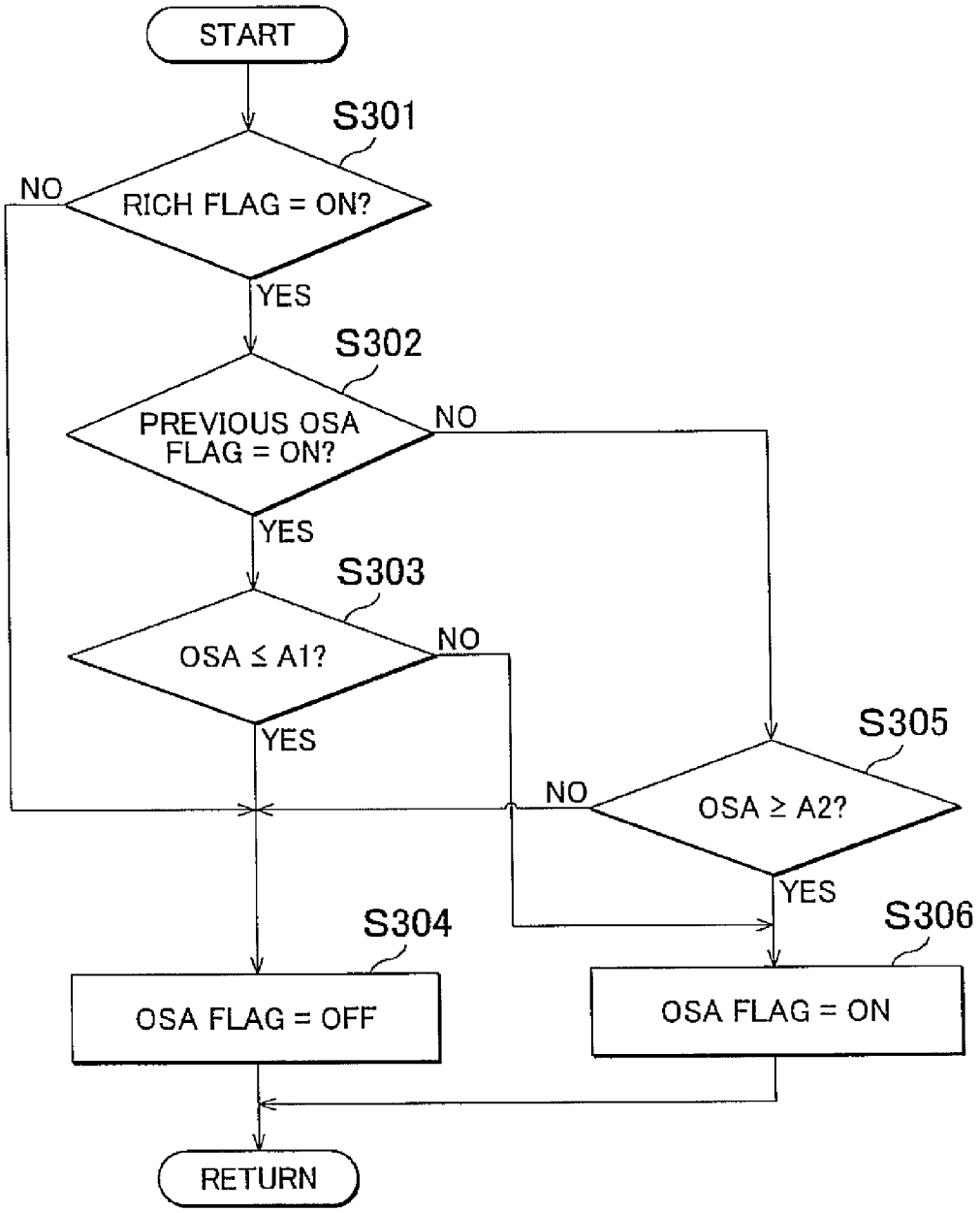
FIG. 12 is a flowchart of an OSA flag process routine in accordance with the embodiment.

Next, a routine regarding the OSA flag process will be described with reference to FIG. 12. Execution of this routine is also repeated by the ECU 20 at every predetermined computation cycle τ.

Firstly, in step S301, it is determined whether the rich flag is on. If the rich flag is not on, the process proceeds to step S304, in which the OSA flag is turned off.

On the other hand, if the rich flag is on, the process proceeds to step S302, in which it is determined whether the OSA flag at the previous computation timing is on. If the OSA flag is on, it means that the rich control is being executed and therefore the measured value of the stored oxygen amount OSA is decreasing. In this case, the process proceeds to step S303, in which it is determined whether the measured value of the stored oxygen amount OSA is less than or equal to the lower-limit threshold value A1, that is, it is determined whether the measured value of the stored oxygen amount OSA has substantially reached the lower-limit threshold value A1. If the measured value of the stored oxygen amount OSA is less than or equal to the lower-limit threshold value A1, the process proceeds to step S304, in which the OSA flag is turned off. If the measured value of the stored oxygen amount OSA is greater than the lower-limit threshold value A1, the process proceeds to step S306, in which the OSA flag is turned on.

On the other hand in step S302, if it is determined that the OSA flag at the previous computation timing is not on (is off), it means that the rich control is the stopped state and the measured value of the stored oxygen amount OSA is increasing. In this case, the process proceeds to step S305, in which it is determined whether the measured value of the stored oxygen amount OSA is greater than or equal to the upper-limit threshold value A2, that is, it is determined whether the measured value of the stored oxygen amount OSA has substantially reached the upper-limit threshold value A2. If the measured value of the stored oxygen amount OSA is greater than or equal to the upper-limit threshold value A2, the process proceeds to step S306, in which the OSA flag is turned on.

On the other hand, if the measured value of the stored oxygen amount OSA is less than the upper-limit threshold value A2, the process proceeds to step S304, in which the OSA flag is turned off.

(Rich-Control Routine)

Figure 13:
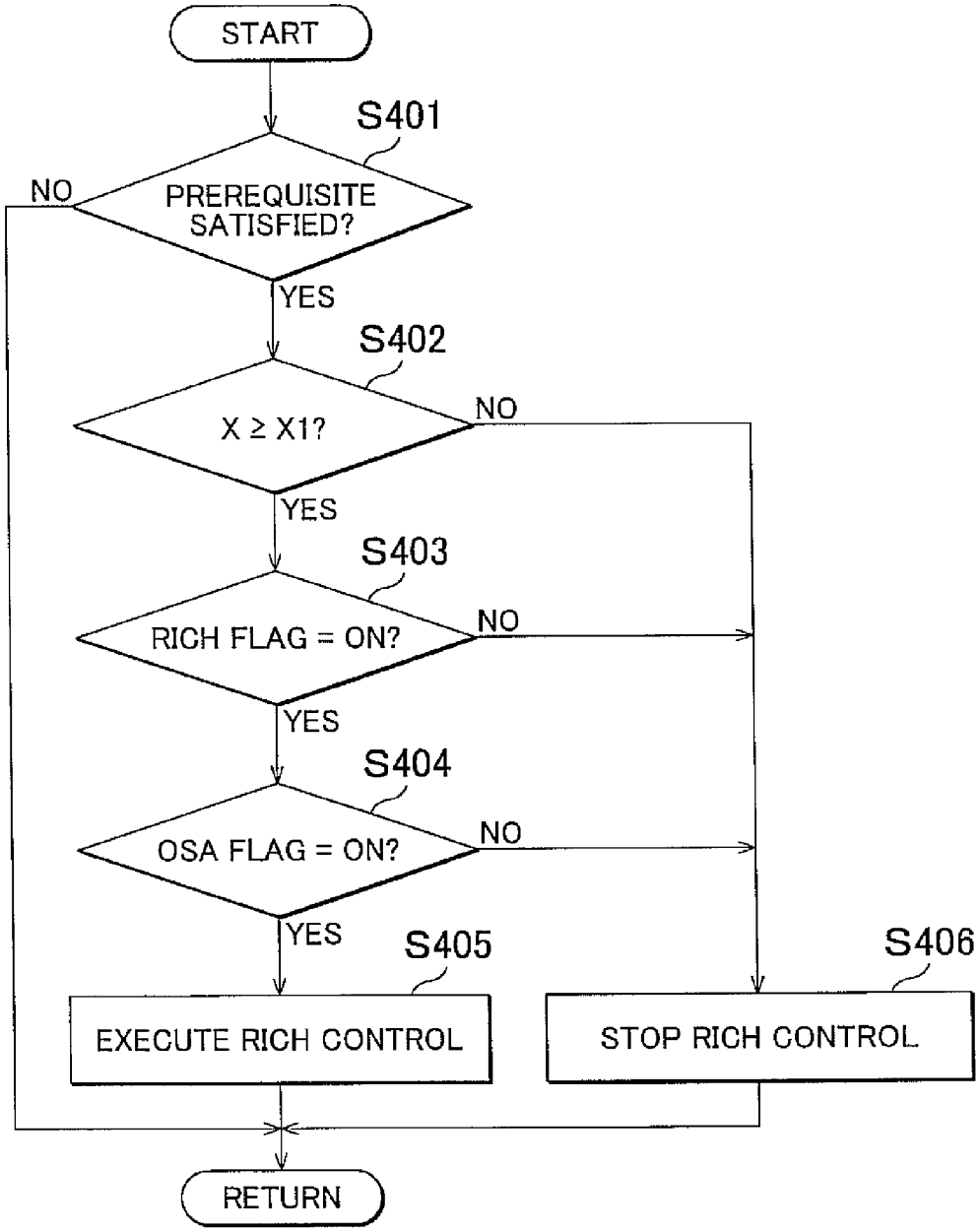
FIG. 13 is a flowchart of a rich-control routine in accordance with the embodiment.

Next, a routine regarding the rich control will be described with reference to FIG. 13. Execution of this routine is also repeated by the ECU 20 at every predetermined computation cycle τ.

Firstly, in step S401, it is determined whether a predetermined prerequisite for executing the rich control is satisfied. This prerequisite is satisfied, for example, when the first to third conditions mentioned above in conjunction with step S101 are satisfied.

If the prerequisite is not satisfied, the routine is ended. On the other hand, if the prerequisite is satisfied, it is determined in step S402 whether the value of the output fluctuation parameter X detected in the routine shown in FIG. 10 is greater than or equal to a predetermined variation criterion value X1. The variation criterion value X1 is a value that corresponds to a relatively large degree of inter-cylinder air/fuel ratio variation such that if the rich control is not carried out, the amount of NOx emissions exceeds a permissible level, and, for example, is a value that corresponds to 30(%) in the imbalance proportion. In the case where the detected value of the output fluctuation parameter X is compared with a predetermined abnormality criterion value to detect the inter-cylinder air/fuel ratio variation abnormality, the variation criterion value X1 may be equal to the abnormality criterion value.

If the detected value of the output fluctuation parameter X is greater than or equal to the variation criterion value X1, the process proceeds to step S403, in which it is determined whether the rich flag is on, that is, it is determined whether the operation state of the engine is within the enrichment region. If the rich flag is on, the process proceeds to step S404, in which it is determined whether the OSA flag is on, that is, it is determined whether the stored oxygen amount OSA of the upstream catalyst 11 is sufficiently large to process HC. If the OSA flag is on, the process proceeds to step S405, in which the rich control is executed.

On the other hand, if in step S402 the detected value of the output fluctuation parameter X is less than the variation criterion value X1, or if in step S403 the rich flag is off, or if in step S404 the OSA flag is off, the process proceeds to step S406, in which the rich control is stopped. Due to this operation, the usual air/fuel ratio feedback control in which the target air/fuel ratio is the stoichiometric ratio is executed.

This embodiment also has advantages as follows. The embodiment has an advantage of being able to restraining increases in the amount of HC emissions by suitably executing or stopping the rich control not only when the value of the output fluctuation parameter X becomes large due to the inter-cylinder air/fuel ratio variation abnormality (at the time of variation abnormality) but also when although there is no abnormality, the value of the output fluctuation parameter X happens to be large due to transitional changes of the operation state of the engine or the like (at the time of normality). That is, this embodiment is also effective at the time of normality when the inter-cylinder air/fuel ratio variation abnormality is absent. Other examples of the time of normality include the case where the adapted value becomes inappropriate for the actual operation state of the engine and the enrichment is excessively performed during the rich control.

Other Embodiments

Next, other embodiments will be described. Descriptions of substantially the same portions as in the foregoing embodiment are omitted from the following description, in which differences from the foregoing embodiment will be centrally described.

Firstly, a first modification will be described. In the first modification, during execution of the rich control, the degree of enrichment is changed according to the measured stored oxygen amount OSA.

That is, in the foregoing embodiment, the target air/fuel ratio A/Ftr during the rich control is variably set according to the engine load KL, the number of engine revolutions Ne and the output fluctuation parameter X. In the first modification, however, the target air/fuel ratio A/Ftr during the rich control is variably set according to the stored oxygen amount OSA in addition to the aforementioned three factors.

Figure 14:
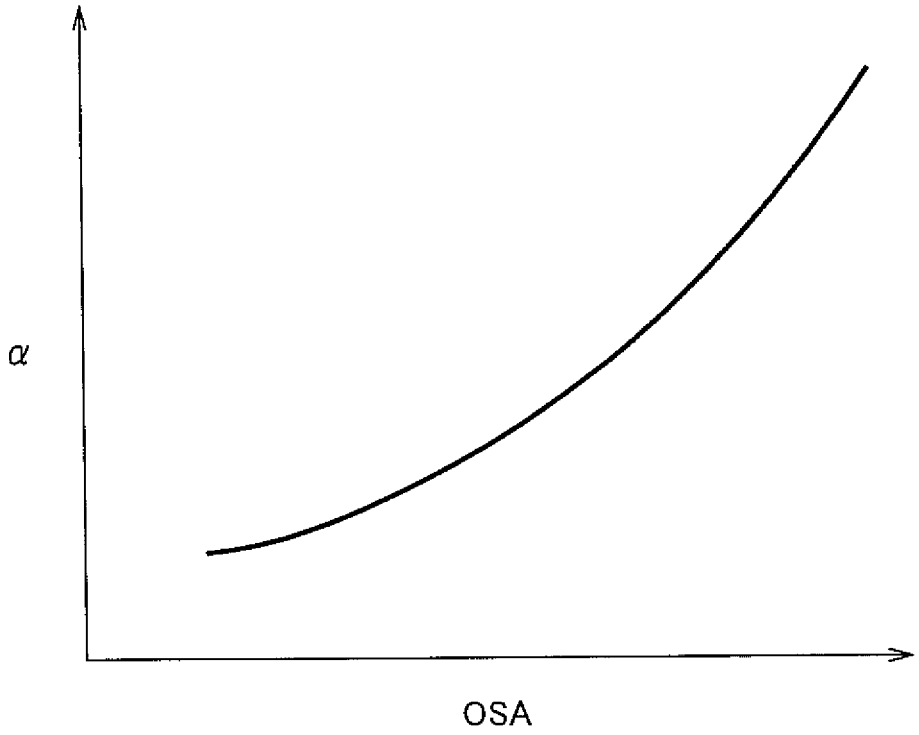
FIG. 14 is a graph showing a relation between the stored oxygen amount and the rich correction amount in accordance with a first modification of the embodiment.

FIG. 14 shows a relation between the stored oxygen amount OSA and the rich-correction amount $\alpha$. As the stored oxygen amount OSA is larger, the rich-correction amount $\alpha$ is set larger, and the value of the target air/fuel ratio A/Ftr becomes smaller (see the expression (2)), so that the degree of enrichment is made larger.

In this case, as shown in FIGS. 9A to 9G, for example, immediately after time t2 when the rich control is initially started, the measured value of the stored oxygen amount OSA is relatively large; therefore, the value of the target air/fuel ratio A/Ftr is small, so that the degree of enrichment is made relatively large. At this time, since the upstream catalyst 11 still has a sufficient amount of stored oxygen, the problem with HC emissions does not occur even if the degree of enrichment is enlarged.

After that, the rich control is continued. As the measured value of the stored oxygen amount OSA gradually decreases, the value of the target air/fuel ratio A/Ftr is gradually made larger, and the degree of enrichment is gradually made smaller. That is, the degree of enrichment is decreased with decreases in the stored oxygen amount of the upstream catalyst 11.

Hence, the degree of enrichment can be decreased in accordance with declines in the HC processing capability of the upstream catalyst 11, so that increases in the amount of HC emissions can be further restrained.

Incidentally, the first modification is also applicable to the second example of the rich control, that is, the case where the fuel injection amount is increased during the rich control.

Next, a second modification will be described. In the second modification, when an output fluctuation parameter X that is greater than or equal to the variation criterion value X1 is detected, the cylinder, that is an abnormal cylinder, from which the output fluctuation parameter X results is determined, that is, pinpointed. Then, the value of the stored oxygen amount that serves as a reference for stopping the rich control (i.e., the lower-limit threshold value A1) is changed according to the magnitude of gas impact of the exhaust gas discharged from the abnormal cylinder on the pre-catalyst sensor 17.

In the case of a multicylinder engine, the gas impact magnitude, that is, the magnitude of the impact of exhaust gas on the pre-catalyst sensor 17, varies according to the cylinders. The differences in the gas impact magnitude among the cylinders are attributed mainly to the position where the pre-catalyst sensor 17 is installed, the structure of the exhaust passageway on the upstream side of the sensor. Because of the differences in the gas impact magnitude, an appropriate value of the lower-limit threshold value A1 varies depending on which cylinder is the abnormal cylinder. Hence, in the second modification, the appropriate value of the lower-limit threshold value A1 is set according to the abnormal one of the cylinders.

The differences in the gas impact magnitude among the cylinders can be empirically grasped beforehand, and the correspondence relation between the cylinder numbers and the gas impact magnitude can be input to the ECU 20 beforehand as information.

Figure 15:
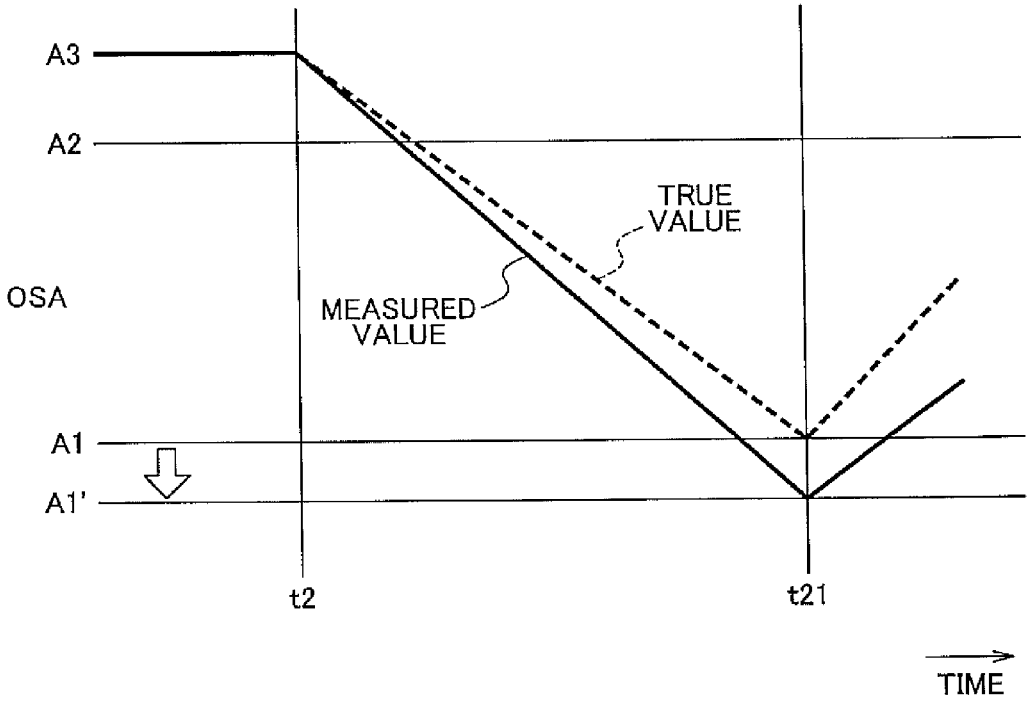
FIG. 15 is a time chart showing changes in the stored oxygen amount in accordance with a second modification of the embodiment in the case where an abnormal cylinder has a great magnitude of gas impact.

FIG. 15 shows changes in the stored oxygen amount OSA that occur in the case where the abnormal cylinder having an air/fuel ratio rich deviation is a cylinder that has a strong gas impact magnitude. FIG. 15 shows an enlargement of a portion at time t2 to t21 in FIG. 9E. A solid line shows the measured values of the stored oxygen amount OSA, and an interrupted line shows true values of the stored oxygen amount OSA.

If the abnormal cylinder is a cylinder that has a great gas impact magnitude, the true value of the stored oxygen amount OSA tends to be larger than the measured value of the stored oxygen amount OSA. A reason for this is as follows.

That is, the pre-catalyst sensor 17 conspicuously receives a rich gas from the abnormal cylinder, and due to the influence of the reception, the value of the output fluctuation parameter X becomes relatively large, so that the degree of enrichment in the rich control becomes large (see FIG. 7). However, the true air/fuel ratio of the total gas is not as rich as the air/fuel ratio detected by the pre-catalyst sensor 17. Hence, due to the influence of the detection error, the true value of the stored oxygen amount OSA tends to be greater than the measured value of the stored oxygen amount OSA.

Then, at the time point when the measured value reaches the lower-limit threshold value A1 that is a reference, the true value has not reached the lower-limit threshold value A1 yet, and the upstream catalyst 11 has not sufficiently thoroughly released the stored oxygen. Therefore, the lower-limit threshold value is changed from the reference value A1 to a value A1' that is smaller than the reference value A1. The value A1' is such a value that the true value reaches the reference value A1 at the time point at which the measured value reaches the value A1'. Due to this changing, the rich control can be continued until the true stored oxygen amount OSA reaches the reference value A1, so that the rich control can be prevented from being stopped sooner than it is supported to be.

Figure 16:
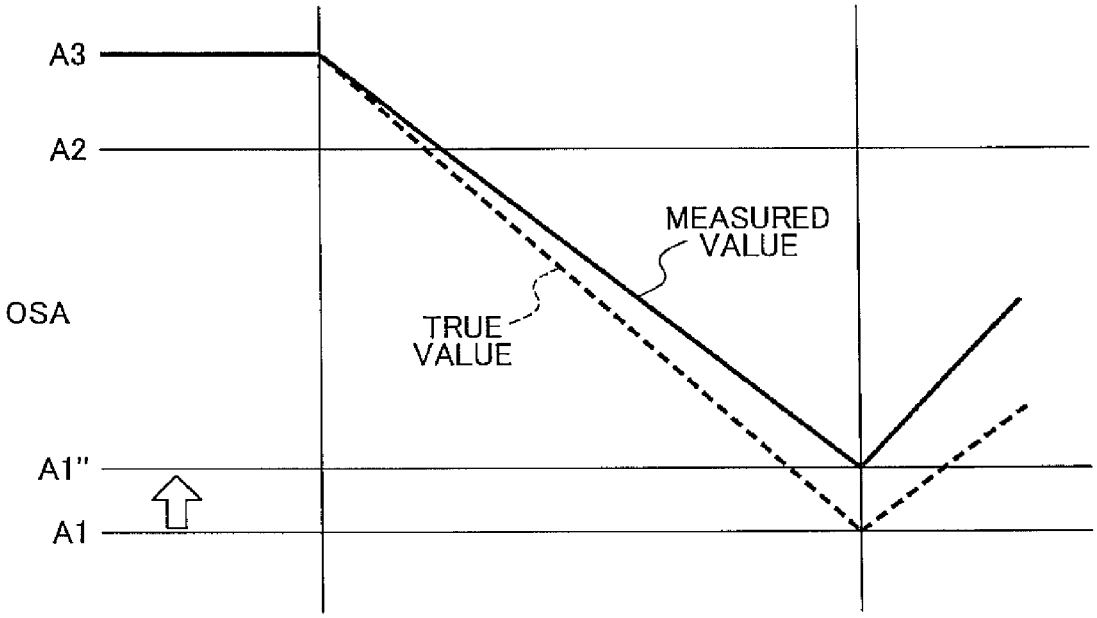
FIG. 16 is a time chart showing changes in the stored oxygen amount in accordance with a second modification of the embodiment in the case where an abnormal cylinder has a small magnitude of gas impact.

FIG. 16 shows changes in the stored oxygen amount OSA that occur in the case where the abnormal cylinder having an air/fuel ratio rich deviation is a cylinder that has a weak gas impact magnitude. In this case, the true value of the stored oxygen amount OSA tends to be smaller than the measured value of the stored oxygen amount OSA. A reason for this is as follows.

Since the rich gas from the abnormal cylinder is less apt to affect the pre-catalyst sensor 17, the value of the output fluctuation parameter X becomes relatively small, so that the degree of enrichment in the rich control becomes small (see FIG. 7). However, the true air/fuel ratio of total gas is richer than the air/fuel ratio detected by the pre-catalyst sensor 17. Hence, due to the influence of this detection error, the true value of the stored oxygen amount OSA tends to be less than the measured value of the stored oxygen amount OSA.

Then, if the rich control is continued until the measured value reaches the lower-limit threshold value A1 that is the reference, the true value becomes lower than the lower-limit threshold value A1 by the time point when the measured value reaches the lower-limit threshold value A1. Therefore, the lower-limit threshold value is changed from the reference value A1 to a value A1" that is greater than the reference value A1. This value A1" is such a value that the true value reaches the reference value A1 at the time point at which the measured value reaches the value A1". This changing prevents the rich control from being continued after the true stored oxygen amount OSA reaches the reference value A1, and therefore prevents the rich control from being continued longer than it is supposed to be. Furthermore, the increase in the amount of HC emissions resulting from the elongated continuation of the rich control can also be prevented.

Figure 17:
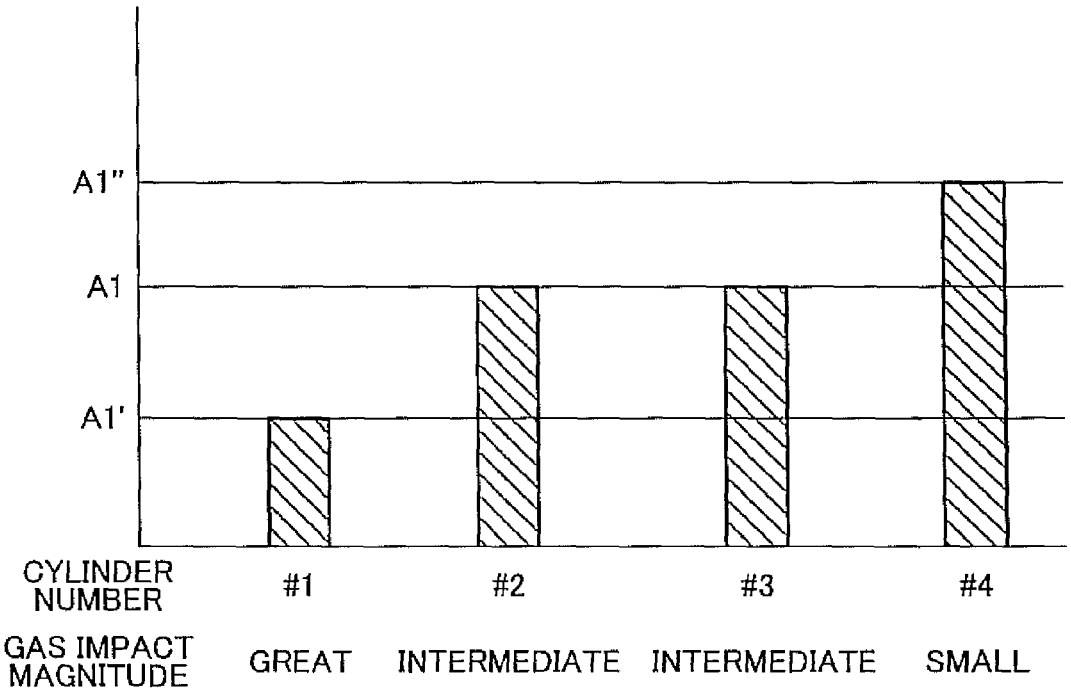
FIG. 17 is a graph showing lower-limit threshold values of the cylinders in accordance with the second modification of the embodiment.

FIG. 17 shows the values of the lower-limit threshold value for the cylinders in the second modification of the embodiment. The gas impact magnitudes of the #2 and #3 cylinders are intermediate levels. When either one of the two cylinders is an abnormal cylinder, the lower-limit threshold value A1, which is the reference value, is set. The gas impact magnitude of the #1 cylinder is a high level. When the #1 cylinder is an abnormal cylinder, the lower-limit threshold value A1', which is smaller than the reference value, is set. The gas impact magnitude of the #4 cylinder is a low level. When the #4 cylinder is an abnormal cylinder, the lower-limit threshold value A1", which is larger than the reference value, is set. Incidentally, in the second modification of the embodiment, the lower-limit threshold value A1 is changed according to the magnitude of gas impact of the exhaust gas discharged from the abnormal cylinder on the pre-catalyst sensor 17. However, a measured value of the stored oxygen amount OSA may be corrected instead of changing the lower-limit threshold value A1.

Next, a method of specifically determining, that is, pinpointing, an abnormal cylinder will be described. Although various methods can be employed as the pinpointing method, a preferred one of the methods will be described below.

In this embodiment, an abnormal cylinder is pinpointed or determined on the basis of a change in the output fluctuation parameter X which occurs when the fuel injection amount is forced to increase or decrease separately for each cylinder.

When an inter-cylinder air/fuel ratio variation occurs, the magnitude of the output fluctuation parameter X changes according to the degree of the inter-cylinder air/fuel ratio variation as described above, as shown in FIG. 3B. Hence, utilizing this characteristic, the abnormal cylinder is determined. A principle of this method will be described below with reference to FIGS. 18A to 18F.

Figure 18A:
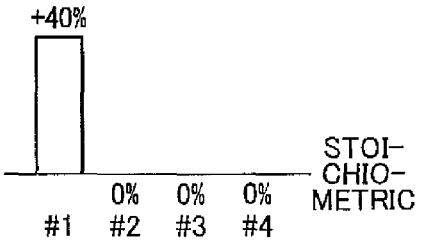
FIGS. 18A to 18F are diagrams for describing a principle of pinpointing an abnormal cylinder in accordance with the second modification of the embodiment.
Figure 18B:
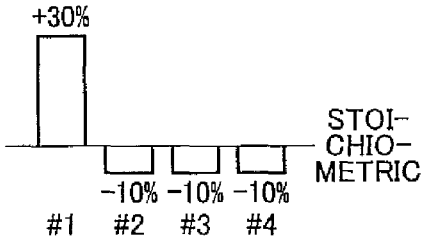

For example, the case where, as shown in FIG. 18A, the fuel injection amount of the #1 cylinder alone is deviated to the rich side from the stoichiometric ratio-corresponding amount by a proportion of 40% (i.e., the imbalance proportion is +40%) and where the fuel injection amounts of the other cylinders, that is, the #2, #3 and #4 cylinders, are equal to the stoichiometric ratio-corresponding amount (i.e., the imbalance proportion is 0%) is assumed. At this time, if the usual air/fuel ratio feedback control is executed for a certain amount of time, the #1 cylinder has an imbalance proportion of +30% and the #2, #3 and #4 cylinders have an imbalance proportion of −10% as shown in FIG. 18B so that the fuel injection amount in total becomes equal to the stoichiometric ratio-corresponding amount. At this time, too, an injection amount deviation of the positive or negative sign (i.e., "+" or "−") occurs relative to the stoichiometric ratio-corresponding amount in the cylinders. Hence, a relatively large fluctuation in the exhaust air/fuel ratio occurs during one engine cycle, so that the value of the output fluctuation parameter X is large.

Figure 18C:
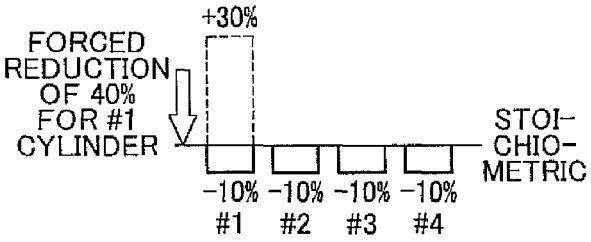

The fuel injection amount of the #1 cylinder is forced to decrease from the level shown in FIG. 18B, for example, by 40% of the stoichiometric ratio-corresponding amount, as shown in FIG. 18C. As a result of this, the imbalance proportion of the #1 cylinder becomes −10%, which is equal to the imbalance proportion of the #2, #3 and #4 cylinders.

Figure 18D:
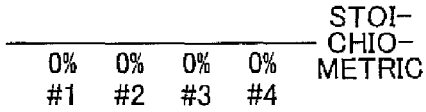

If, from this state, the usual air/fuel ratio feedback control is executed for a certain amount of time while the state of reduced fuel injection amount of the #1 cylinder is maintained, the fuel injection amount of each cylinder is corrected by +10% as shown in FIG. 18D, so that the fuel injection amounts of the cylinders become equal to the stoichiometric ratio-corresponding amount (i.e., the imbalance proportion of each cylinder is 0%). Hence, the fluctuation of the exhaust air/fuel ratio during one engine cycle lessens, and the value of the output fluctuation parameter X lessens.

Therefore, a cylinder whose output fluctuation parameter X declines by a predetermined value or more when the fuel injection amount is forced to decrease by a predetermined amount can be determined as being an abnormal cylinder (in particular, a rich-deviation abnormality cylinder).

Figure 18E:
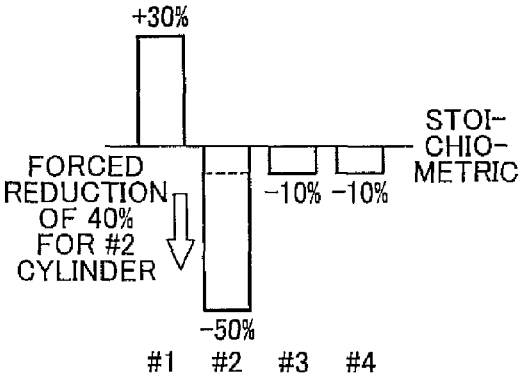

On another hand, let it assumed that the fuel injection amount of the #2 cylinder, which is normal, is forced to decrease from the level shown in FIG. 18B, for example, by 40% of the stoichiometric ratio-corresponding amount as shown in FIG. 18E. As a result of this, the imbalance proportion of the #1 cylinder remains unchanged, that is, +30%, and the imbalance proportion of the #2 cylinder is −50%, and the imbalance proportion of the #3 and #4 cylinders remains unchanged, that is, −10%.

Figure 18F:
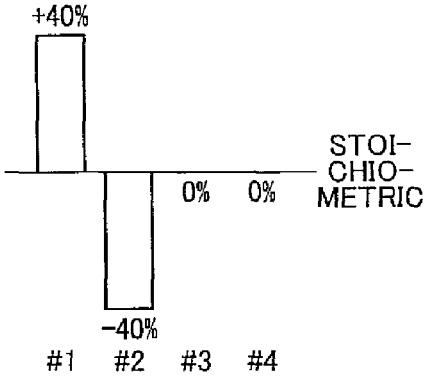

If, from this state, the usual air/fuel ratio feedback control is executed for a certain amount of time while the state of reduced fuel injection amount of the #2 cylinder is maintained, the imbalance proportion of the #1 cylinder becomes +40% and the imbalance proportion of the #2 cylinder becomes −40% and the imbalance proportions of the #3 and #4 cylinders become 0% so that the total fuel injection amount becomes equal to the stoichiometric ratio-corresponding amount as shown in FIG. 18F. In this case, the fluctuation of the exhaust air/fuel ratio during one engine cycle remains still large; and the value of the output fluctuation parameter X remains still large.

Therefore, a cylinder whose output fluctuation parameter X does not decline by a predetermined value or more when the fuel injection amount is forced to decrease by a predetermined amount can be determined as not being an abnormal cylinder but being a normal cylinder.

Although not shown in the drawings, a situation opposite to the above-described situation, for example, the case where in the example shown in FIG. 18A, only the #1 cylinder is abnormal and its fuel injection amount is less by −40% (i.e., the imbalance proportion is −40%), is assumed. Therefore, if the fuel injection amount is forced to increase separately for each cylinder, it can be determined that a cylinder whose output fluctuation parameter X decreases by a predetermined value or more is an abnormal cylinder (in particular, a lean-deviation abnormality cylinder), and that a cylinder whose output fluctuation parameter X does not decrease by the predetermined value or more is a normal cylinder.

Thus, the amount of change in the output fluctuation parameter X of each cylinder between before and after the fuel injection amount of that cylinder is forced to increase or decrease is detected, and a cylinder whose amount of change in the output fluctuation parameter X is greater than or equal to a predetermined value is determined as being an abnormal cylinder, and a cylinder whose amount of change in the output fluctuation parameter X is less than the predetermined value is determined as being a normal cylinder.

Figure 19:
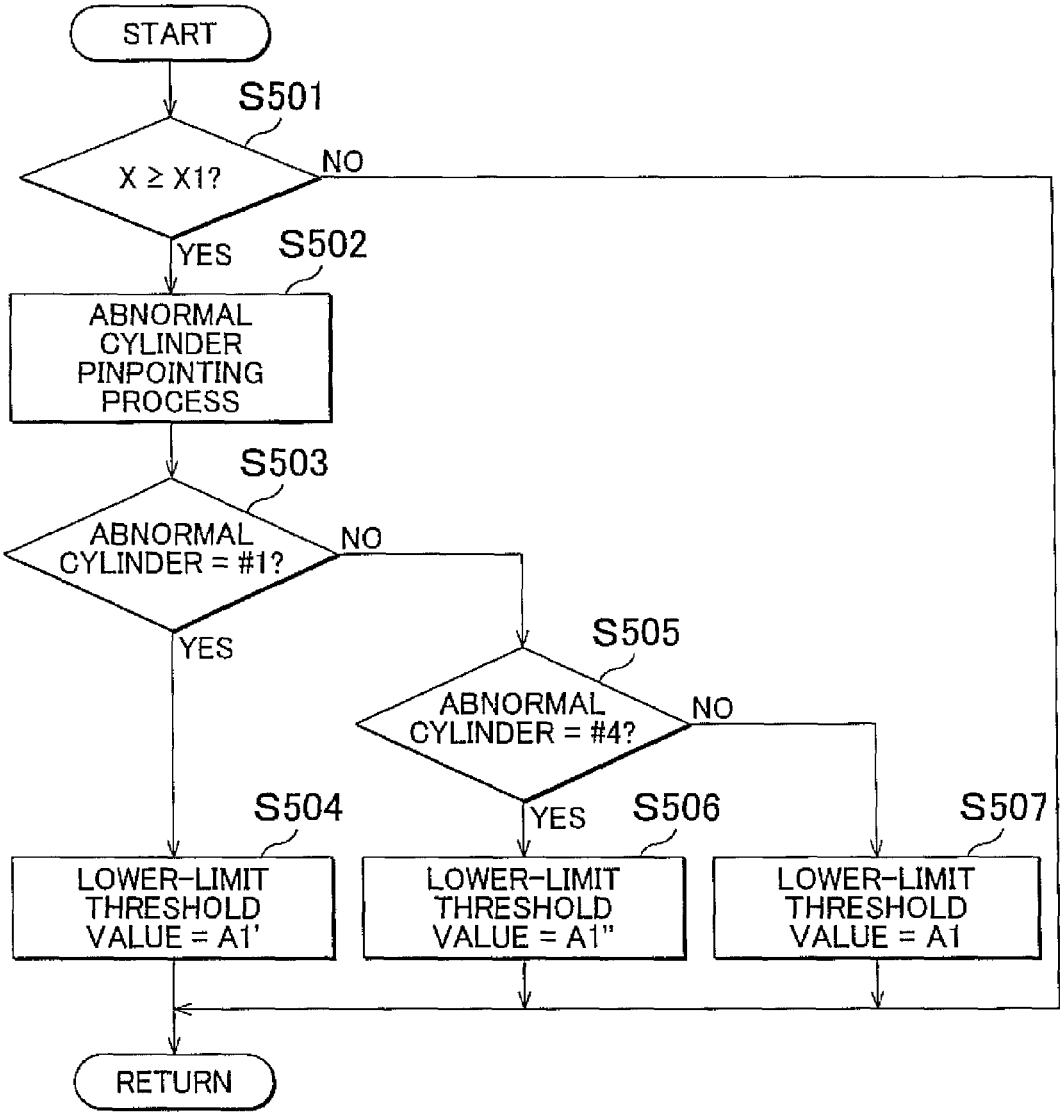
FIG. 19 is a flowchart of a lower-limit threshold value setting routine in accordance with the second modification of the embodiment.

A routine regarding the setting of the lower-limit threshold value will be described with reference to FIG. 19. This routine is also executed by the ECU 20.

Figure 10:
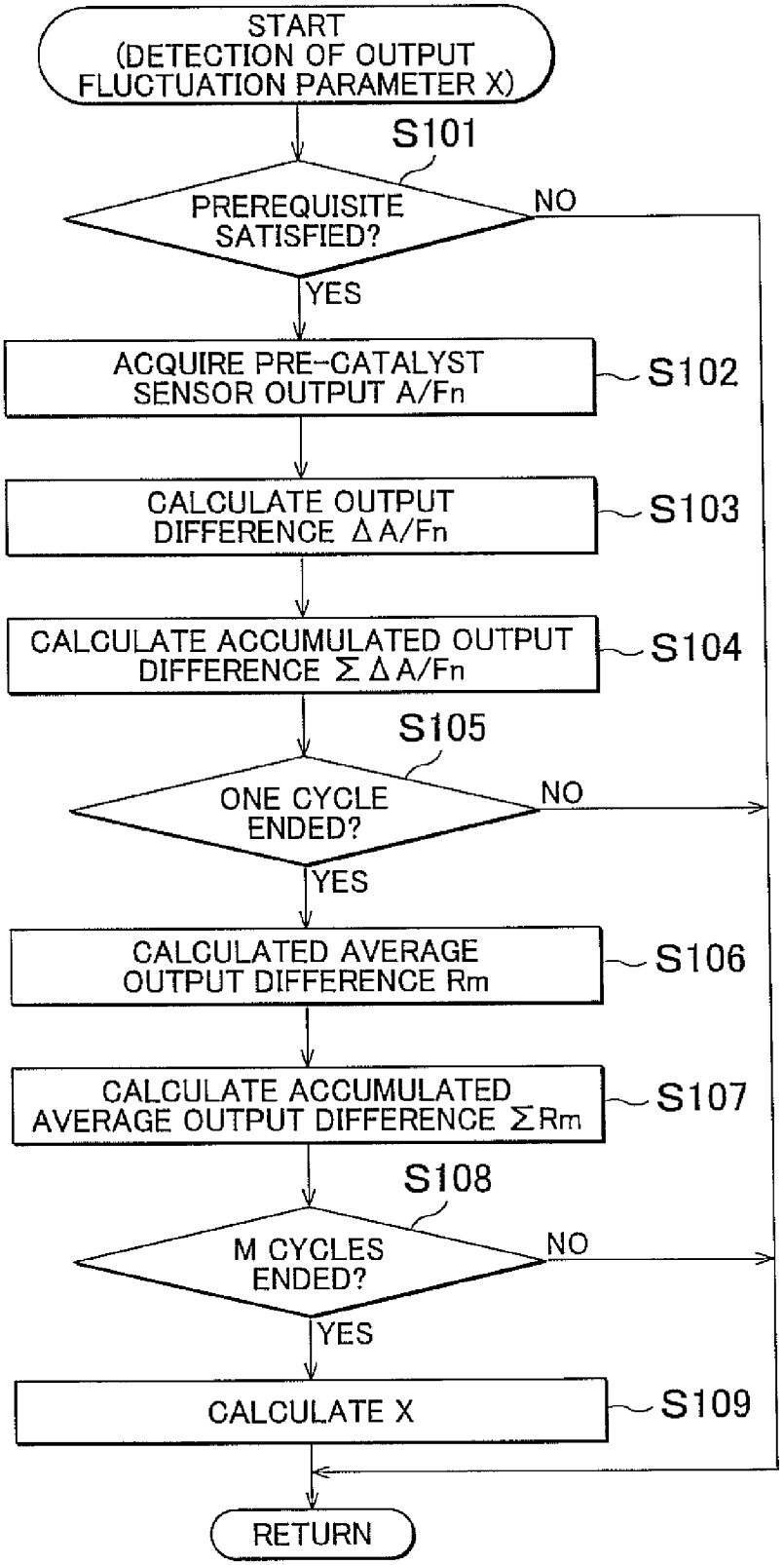
FIG. 10 is a flowchart of an output fluctuation parameter detection routine in accordance with the embodiment.

Firstly, in step S501, it is determined whether the value of the output fluctuation parameter X detected in the routine shown in FIG. 10 is greater than or equal to a variation criterion value X1. If the value of the output fluctuation parameter X is less than the variation criterion value X1, the routine is ended.

On the other hand, if the value of the output fluctuation parameter X is greater than or equal to the variation criterion value X1, the process proceeds to step S502, in which an abnormal cylinder-pinpointing process that involves the forced increase (or decrease) of the fuel injection amount as described above is executed. The abnormal cylinder refers to a cylinder that causes the detected value of the output fluctuation parameter X to become greater than or equal to the variation criterion value X1.

Next, in step S503, it is determined whether the determined or pinpointed abnormal cylinder is the #1 cylinder. If the determined abnormal cylinder is the #1 cylinder, the process proceeds to step S504, in which a value A1' that is smaller than the reference value A1 is set as a lower-limit threshold value.

On the other hand, if in step S503 it is determined that the pinpointed abnormal cylinder is not the #1 cylinder, the process proceeds to step S505, in which it is determined whether the pinpointed abnormal cylinder is the #4 cylinder. If the pinpointed abnormal cylinder is the #4 cylinder, the process proceeds to step S506, in which a value A1" that is greater than the reference value A1 is set as the lower-limit threshold value.

On the other hand, if in step S505 it is determined that the pinpointed abnormal cylinder is not the #4 cylinder, the pinpointed abnormal cylinder is either the #2 cylinder or the #3 cylinder, and the process proceeds to step S507, in which the reference value A1 is set as the lower-limit threshold value.

Incidentally, the upper-limit threshold value A2 of the stored oxygen amount, which serves as a reference for resuming the rich control, can also be changed according to the magnitude of gas impact of the exhaust gas from the abnormal cylinder on the pre-catalyst sensor 17.

While preferred embodiments of the invention have been described above, various other embodiments of the invention are also conceivable. The aforementioned numerical values are merely illustrative, and can be changed to other values.

The embodiments of the invention are not limited to the foregoing embodiments, but the invention includes all modifications, applications and equivalents encompassed within the idea of the invention defined by the appended claims. Therefore, the invention should not be interpreted in a limited manner, but can also be applied to other arbitrary technologies that belong to the range of the idea of the invention.

What is claimed is:

1. A control apparatus for a multicylinder internal combustion engine, comprising:

a detection portion that detects a parameter that represents degree of variation in air/fuel ratio among cylinders of the multicylinder internal combustion engine;

a measurement portion that measures a stored oxygen amount of a catalyst provided in an exhaust passageway of the internal combustion engine; and a rich-control portion that switches between execution and stop of a rich control for enriching the air/fuel ratio according to the stored oxygen amount measured by the measurement portion when the parameter detected by the detection portion is greater than or equal to a predetermined value.

2. The control apparatus according to claim 1, wherein the rich-control portion switches between the execution and the stop of the rich control so that the stored oxygen amount does not become less than a predetermined lower-limit threshold value.

3. The control apparatus according to claim 2, wherein the predetermined lower-limit threshold value is set a lower limit value such that an HC processing capability of the catalyst is able to be secured.

4. The control apparatus according to claim 1, wherein when the stored oxygen amount decreases and reaches a predetermined lower-limit threshold value during the execution of the rich control, the rich-control portion switches the rich control to the stop.

5. The control apparatus according to claim 4, wherein the predetermined lower-limit threshold value is set a lower limit value such that an HC processing capability of the catalyst is able to be secured.

6. The control apparatus according to claim 1, wherein when the stored oxygen amount increases and reaches a predetermined upper-limit threshold value during the stop of the rich control, the rich-control portion switches the rich control to the execution.

7. The control apparatus according to claim 1, wherein during the execution of the rich control, the rich-control portion changes degree of enrichment according to the stored oxygen amount measured by the measurement portion.

8. The control apparatus according to claim 1, wherein:

when the parameter detected by the detection portion is greater than or equal to a predetermined value, the rich-control portion determines an abnormal cylinder that is a cylinder from which detection of the parameter being greater than or equal to the predetermined value results; and the rich-control portion changes a value of the stored oxygen amount which serves as a reference for stopping the rich control, according to magnitude of gas impact of exhaust gas from the abnormal cylinder on an air/fuel ratio sensor that is provided at an upstream side of the catalyst.

9. The control apparatus according to claim 8, wherein:

the rich-control portion lessens the value of the stored oxygen amount which serves as the reference for stopping the rich control, if the magnitude of gas impact of exhaust gas from the abnormal cylinder on an air/fuel ratio sensor is great.

10. The control apparatus according to claim 8, wherein:

the rich-control portion enlarges the value of the stored oxygen amount which serves as the reference for stopping the rich control, if the magnitude of gas impact of exhaust gas from the abnormal cylinder on an air/fuel ratio sensor is small.

11. The control apparatus according to claim 4, wherein:

when the parameter detected by the detection portion is greater than or equal to a predetermined value, the rich-control portion determines an abnormal cylinder that is a cylinder from which detection of the parameter being greater than or equal to the predetermined value results; and the rich-control portion changes the predetermined lower-limit threshold value or corrects a measured value of the stored oxygen amount, according to magnitude of gas impact of exhaust gas from the abnormal cylinder on an air/fuel ratio sensor that is provided at an upstream side of the catalyst.

12. The control apparatus according to claim 1, wherein the rich-control portion executes the rich control at least when load of the internal combustion engine is greater than or equal to a predetermined value.

13. The control apparatus according to claim 1, further comprising:

an air/fuel ratio sensor provided at an upstream side of the catalyst; and an air/fuel ratio control portion that executes an air/fuel ratio feedback control so that a detected air/fuel ratio provided by the air/fuel ratio sensor is equal to a predetermined target air/fuel ratio.

14. The control apparatus according to claim 13, wherein when the rich control is executed, the rich-control portion enriches at least one of the target air/fuel ratio and a fuel injection amount in the air/fuel ratio feedback control.

* * * * *